US009078473B2

(12) United States Patent
Worm et al.

(10) Patent No.: US 9,078,473 B2
(45) Date of Patent: Jul. 14, 2015

(54) SMOKING ARTICLES AND USE THEREOF FOR YIELDING INHALATION MATERIALS

(75) Inventors: Steven L. Worm, Raleigh, NC (US); David G. Christopherson, Raleigh, NC (US); Stephen Benson Sears, Siler City, NC (US); Dennis Lee Potter, Kernersville, NC (US); Frederic Philippe Ampolini, Winston-Salem, NC (US); Balager Ademe, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 951 days.

(21) Appl. No.: 13/205,841

(22) Filed: Aug. 9, 2011

(65) Prior Publication Data

US 2013/0037041 A1 Feb. 14, 2013

(51) Int. Cl.
*A24F 47/00* (2006.01)

(52) U.S. Cl.
CPC ..... *A24F 47/008* (2013.01)

(58) Field of Classification Search
USPC ..... 131/191, 198.1, 199, 216, 219, 224, 131/329, 347, 351, 352, 365, 359–361; 128/200.24, 202.21, 203.26, 203.27
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 8/1965 | Gilbert |
| 3,316,919 | A | 5/1967 | Green et al. |
| 3,398,754 | A | 8/1968 | Tughan |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |
| 4,150,677 | A | 4/1979 | Osborne |
| 4,190,046 | A | 2/1980 | Virag |
| 4,219,032 | A | 8/1980 | Tabatznik et al. |
| 4,259,970 | A | 4/1981 | Green, Jr. |
| 4,284,089 | A | 8/1981 | Ray |
| 4,303,083 | A | 12/1981 | Burruss, Jr. |
| 4,449,541 | A | 5/1984 | Mays et al. |
| 4,506,682 | A | 3/1985 | Muller |
| 4,635,651 | A | 1/1987 | Jacobs |
| 4,674,519 | A | 6/1987 | Keritsis et al. |
| 4,708,151 | A | 11/1987 | Shelar |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Dennis Cordray
(74) *Attorney, Agent, or Firm* — Womble Carlyle Sandridge & Rice, LLP

(57) ABSTRACT

The present invention describes articles, such as smoking articles, that can provide an inhalable substance in a form suitable for inhalation by a consumer. The article comprises a cartridge with an inhalable substance medium therein, control housing that includes an electrical energy source and an electrical power source, and a heating member that may be located in either the cartridge or the control housing. The control housing further may include puff-actuated current actuation components and current regulation components.

79 Claims, 9 Drawing Sheets

(56) References Cited

U.S. PATENT DOCUMENTS 4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,143,097 A 9/1992 Sohn et al.
5,144,962 A 9/1992 Counts et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 6/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,216,706 B1 4/2001 Kumar et al.

(56) References Cited

U.S. PATENT DOCUMENTS

| | | | |
|---|---|---|---|
| 6,289,898 | B1 | 9/2001 | Fournier et al. |
| 6,349,728 | B1 | 2/2002 | Pham |
| 6,357,671 | B1 | 3/2002 | Cewers |
| 6,418,938 | B1 | 7/2002 | Fleischhauer et al. |
| 6,446,426 | B1 | 9/2002 | Sweeney et al. |
| 6,532,965 | B1 | 3/2003 | Abhulimen et al. |
| 6,598,607 | B2 | 7/2003 | Adiga et al. |
| 6,601,776 | B1 | 8/2003 | Oljaca et al. |
| 6,615,840 | B1 | 9/2003 | Fournier et al. |
| 6,688,313 | B2 | 2/2004 | Wrenn et al. |
| 6,701,936 | B2 | 3/2004 | Shafer et al. |
| 6,715,494 | B1 | 4/2004 | McCoy |
| 6,730,832 | B1 | 5/2004 | Dominguez et al. |
| 6,772,756 | B2 | 8/2004 | Shayan |
| 6,803,545 | B2 | 10/2004 | Blake et al. |
| 6,803,550 | B2 | 10/2004 | Sharpe et al. |
| 6,810,883 | B2 | 11/2004 | Felter et al. |
| 6,854,461 | B2 | 2/2005 | Nichols et al. |
| 6,854,470 | B1 | 2/2005 | Pu |
| 6,994,096 | B2 | 2/2006 | Rostami et al. |
| 7,011,096 | B2 | 3/2006 | Li et al. |
| 7,017,585 | B2 | 3/2006 | Li et al. |
| 7,025,066 | B2 | 4/2006 | Lawson et al. |
| 7,117,867 | B2 | 10/2006 | Cox et al. |
| 7,163,015 | B2 | 1/2007 | Moffitt |
| 7,173,222 | B2 | 2/2007 | Cox et al. |
| 7,185,659 | B2 | 3/2007 | Sharpe et al. |
| 7,234,470 | B2 | 6/2007 | Yang |
| 7,290,549 | B2 | 11/2007 | Banerjee et al. |
| 7,293,565 | B2 | 11/2007 | Griffin et al. |
| 7,392,809 | B2 | 7/2008 | Larson et al. |
| 7,513,253 | B2 | 4/2009 | Kobayashi et al. |
| 7,647,932 | B2 | 1/2010 | Cantrell et al. |
| 7,690,385 | B2 | 4/2010 | Moffitt |
| 7,692,123 | B2 | 4/2010 | Baba et al. |
| 7,726,320 | B2 | 6/2010 | Robinson et al. |
| 7,810,505 | B2 | 10/2010 | Yang |
| 7,832,410 | B2 | 11/2010 | Hon |
| 7,878,209 | B2 | 2/2011 | Newbery et al. |
| 7,896,006 | B2 | 3/2011 | Hamano et al. |
| 8,066,010 | B2 | 11/2011 | Newbery et al. |
| 8,079,371 | B2 | 12/2011 | Robinson et al. |
| 2002/0146242 | A1 | 10/2002 | Vieira |
| 2003/0131859 | A1 | 7/2003 | Li et al. |
| 2003/0226837 | A1 | 12/2003 | Blake et al. |
| 2004/0020500 | A1 | 2/2004 | Wrenn et al. |
| 2004/0129280 | A1 | 7/2004 | Woodson et al. |
| 2004/0149296 | A1 | 8/2004 | Rostami et al. |
| 2004/0200488 | A1 | 10/2004 | Felter et al. |
| 2004/0224435 | A1 | 11/2004 | Shibata et al. |
| 2004/0226568 | A1 | 11/2004 | Takeuchi et al. |
| 2004/0255965 | A1 | 12/2004 | Perfetti et al. |
| 2005/0016549 | A1 | 1/2005 | Banerjee et al. |
| 2005/0016550 | A1 | 1/2005 | Katase |
| 2005/0066986 | A1 | 3/2005 | Nestor et al. |
| 2005/0151126 | A1 | 7/2005 | Yamakawa et al. |
| 2005/0172976 | A1 | 8/2005 | Newman et al. |
| 2005/0274390 | A1 | 12/2005 | Banerjee et al. |
| 2006/0016453 | A1 | 1/2006 | Kim |
| 2006/0032501 | A1 | 2/2006 | Hale et al. |
| 2006/0070633 | A1 | 4/2006 | Rostami et al. |
| 2006/0162733 | A1 | 7/2006 | McGrath et al. |
| 2006/0185687 | A1 | 8/2006 | Hearn et al. |
| 2006/0196518 | A1 | 9/2006 | Hon |
| 2007/0074734 | A1 | 4/2007 | Braunshteyn et al. |
| 2007/0102013 | A1 | 5/2007 | Adams et al. |
| 2007/0215167 | A1 | 9/2007 | Crooks et al. |
| 2007/0283972 | A1 | 12/2007 | Monsees et al. |
| 2008/0092912 | A1 | 4/2008 | Robinson et al. |
| 2008/0149118 | A1 | 6/2008 | Oglesby et al. |
| 2008/0245377 | A1 | 10/2008 | Marshall et al. |
| 2008/0257367 | A1 | 10/2008 | Paterno et al. |
| 2008/0276947 | A1 | 11/2008 | Martzel |
| 2008/0302374 | A1 | 12/2008 | Wengert et al. |
| 2009/0065010 | A1 | 3/2009 | Shands |
| 2009/0095311 | A1 | 4/2009 | Hon |
| 2009/0095312 | A1 | 4/2009 | Herbrich et al. |
| 2009/0126745 | A1 | 5/2009 | Hon |
| 2009/0188490 | A1 | 7/2009 | Han |
| 2009/0230117 | A1 | 9/2009 | Fernando et al. |
| 2009/0260641 | A1 | 10/2009 | Monsees et al. |
| 2009/0260642 | A1 | 10/2009 | Monsees et al. |
| 2009/0272379 | A1 | 11/2009 | Thorens et al. |
| 2009/0283103 | A1 | 11/2009 | Nielsen et al. |
| 2009/0293892 | A1 | 12/2009 | Williams et al. |
| 2009/0320863 | A1 | 12/2009 | Fernando et al. |
| 2009/0324206 | A1 | 12/2009 | Young et al. |
| 2010/0006113 | A1 | 1/2010 | Urtsev et al. |
| 2010/0024834 | A1 | 2/2010 | Oglesby et al. |
| 2010/0043809 | A1 | 2/2010 | Magnon |
| 2010/0059070 | A1 | 3/2010 | Potter et al. |
| 2010/0059073 | A1 | 3/2010 | Hoffmann et al. |
| 2010/0065075 | A1 | 3/2010 | Banerjee et al. |
| 2010/0083959 | A1 | 4/2010 | Siller |
| 2010/0163063 | A1 | 7/2010 | Fernando et al. |
| 2010/0200006 | A1 | 8/2010 | Robinson et al. |
| 2010/0229881 | A1 | 9/2010 | Hearn |
| 2010/0242974 | A1 | 9/2010 | Pan |
| 2010/0242976 | A1 | 9/2010 | Katayama et al. |
| 2010/0258139 | A1 | 10/2010 | Onishi et al. |
| 2010/0300467 | A1 | 12/2010 | Kuistila et al. |
| 2010/0307518 | A1 | 12/2010 | Wang |
| 2010/0313901 | A1 | 12/2010 | Fernando et al. |
| 2011/0005535 | A1 | 1/2011 | Xiu |
| 2011/0011396 | A1 | 1/2011 | Fang |
| 2011/0036363 | A1 | 2/2011 | Urtsev et al. |
| 2011/0036365 | A1 | 2/2011 | Chong et al. |
| 2011/0073121 | A1 | 3/2011 | Levin et al. |
| 2011/0088707 | A1 | 4/2011 | Hajaligol |
| 2011/0094523 | A1 | 4/2011 | Thorens et al. |
| 2011/0120482 | A1 | 5/2011 | Brenneise |
| 2011/0126848 | A1 | 6/2011 | Zuber et al. |
| 2011/0155153 | A1 | 6/2011 | Thorens et al. |
| 2011/0155718 | A1 | 6/2011 | Greim et al. |
| 2011/0162663 | A1 | 7/2011 | Bryman |
| 2011/0168194 | A1 | 7/2011 | Hon |
| 2011/0180082 | A1 | 7/2011 | Banerjee et al. |
| 2011/0265806 | A1 | 11/2011 | Alarcon et al. |
| 2011/0309157 | A1 | 12/2011 | Yang et al. |
| 2012/0042885 | A1 | 2/2012 | Stone et al. |
| 2012/0060853 | A1 | 3/2012 | Robinson et al. |
| 2012/0111347 | A1 | 5/2012 | Hon |
| 2012/0132643 | A1 | 5/2012 | Choi et al. |
| 2012/0231464 | A1 | 9/2012 | Yu et al. |
| 2012/0279512 | A1 | 11/2012 | Hon |
| 2012/0318882 | A1 | 12/2012 | Abehasera |
| 2013/0081642 | A1 | 4/2013 | Safari |
| 2013/0306084 | A1 | 11/2013 | Flick |
| 2013/0340775 | A1 | 12/2013 | Juster et al. |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1618803 | 1/2006 |
| EP | 2 316 286 | 5/2011 |
| EP | 2 468 116 | 6/2012 |
| GB | 1444461 | 7/1976 |
| GB | 2469850 | 11/2010 |
| WO | WO 86/02528 | 5/1986 |
| WO | WO 97/48293 | 12/1997 |
| WO | WO 02/37990 | 5/2002 |
| WO | WO 2004/043175 | 5/2004 |

(56) References Cited

FOREIGN PATENT DOCUMENTS

| | | |
|---|---|---|
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2010/073122 | 7/2011 |
| WO | WO 2011/081558 | 7/2011 |

SMOKING ARTICLES AND USE THEREOF FOR YIELDING INHALATION MATERIALS

FIELD OF THE INVENTION

The present invention relates to aerosol delivery articles and uses thereof for yielding tobacco components or other materials in an inhalable form. The articles may be made or derived from tobacco or otherwise incorporate tobacco for human consumption. More particularly, the invention provides articles wherein tobacco, a tobacco derived material, or other material is heated, preferably without significant combustion, to provide an inhalable substance, the substance, in the various embodiments, being in a vapor or aerosol form.

BACKGROUND

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco.

Representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; US Pat. Pub. No. 2009/0095311 to Hon; US Pat. Pub. Nos. 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. Still further examples include products commercially available under the names ACCORD®; HEATBAR™; HYBRID CIGARETTE®, RUYAN VEGAS™; RUYAN E-GAR™; RUYAN C-GAR™; E-MYSTICK™; and IOLITE® Vaporizer.

Articles that produce the taste and sensation of smoking by electrically heating tobacco have suffered from inconsistent release of flavors or other inhalable materials. Electrically heated smoking devices have further been limited in many instances to the requirement of an external heating device that was inconvenient and that detracted from the smoking experience. Accordingly, it can be desirable to provide a smoking article that can provide the sensations of cigarette, cigar, or pipe smoking, that does so without combusting tobacco, that does so without the need of a combustion heat source, and that does not produce combustion products.

SUMMARY OF THE INVENTION

The present invention generally provides articles that may be used for pulmonary delivery of one or more inhalable substances (including nicotine). In certain embodiments, the invention relates to smoking articles that employ an electrical heating element and an electrical power source to provide the inhalable substance in a vapor or aerosol form, and also provide other sensations associated with smoking, preferably without substantially burning or completely burning tobacco or other substances, producing little or no combustion or pyrolysis products, including carbon monoxide, and producing little or no side stream smoke or odor. The electrical heating member provides for heating almost immediately upon taking a puff from the article and can provide for delivery of an aerosol throughout the puff and over about 6 to about 10 puffs on the article, which is similar to the number of puffs obtained from a typical cigarette.

In certain embodiments, the invention thus provides an article for formation of an inhalable substance. The article can comprise a substantially tubular shaped cartridge body having an engaging end, an opposing mouth end configured to allow passage of the inhalable substance to a consumer, and a wall with an outer surface and an inner surface. The inner surface of the cartridge body wall can define an interior cartridge space that includes a substantially tubular shaped inhalable substance medium having a wall with an inner surface and an outer surface so as to define an annular space of a specified volume between the outer surface of the inhalable substance medium wall and the inner surface of the cartridge wall. The inhalable substance medium particularly also can have a first end in proximity to the mouth end of the cartridge and a second end in proximity to the engaging end of the cartridge. The article further can comprise an electrical heating member that heats at least a segment of the inhalable substance medium wall sufficiently to form a vapor comprising the inhalable substance within the annular space. The article also can comprise a control housing having a receiving end that engages the engaging end of the cartridge. Such receiving end may particularly include a chamber with an open end for receiving the engaging end of the cartridge. The control housing further can comprise an electrical energy source (at least part of which can be positioned at the receiving end and/or within the receiving chamber) that provides power to the electrical heating member. In specific embodiments, when the engaging end of the cartridge engages the receiving end of the control housing (such as when it slides a defined distance into the chamber of the control housing), the inhalable substance medium and the electrical heating member align so as to allow for heating of at least a segment of the inhalable substance medium. The electrical energy source (or a component or extension thereof) also may so align with the inhalable substance medium and the electrical heating member.

The inventive article can take on a number of shapes and sizes. For example, the cartridge can be substantially cylindrically shaped. Further, the cartridge can have a cross-section defined by a shape selected from the group consisting of round, oval, and square. The engaging end of the cartridge also can include an opening that is sufficiently sized and shaped to receive at least one component of the electrical energy source. The cartridge also can comprise an overwrap that can be useful to provide various properties to the article. For example, the overwrap may include a filter material positioned in proximity to the mouth end of the cartridge. Thus, the mouth end of the cartridge may be characterized as being partially occluded, which characterization also can relate to further components of the cartridge, such as the cartridge frame at the mouth end of the cartridge.

The inhalable substance medium can comprise a variety of materials useful for facilitating delivery of one or more inhalable substances to a consumer. In particular embodiments, the inhalable substance medium can comprise tobacco and/or a tobacco-derived material. The inhalable substance medium also may comprise an aerosol-forming material, which itself may include a tobacco-derived material. In specific embodiments, the aerosol-forming material can be a polyhydric alcohol (e.g., glycerin). In other embodiments, the inhalable substance medium can comprise a solid substrate. Such substrate may itself comprise tobacco (e.g., a tobacco paper formed from reconstituted tobacco), such that the inhalable substance may be natural to the substrate. Alternatively, the substrate may simply be a paper material or other material that has the inhalable substance coated thereon or that has the inhalable substance absorbed or adsorbed therein. In a particular embodiment, the inhalable substance medium can comprise a slurry of tobacco and an aerosol-forming material coated on or absorbed or adsorbed in the solid substrate. The inhalable substance medium further may comprise other components, such as a vapor barrier on one of the inner surface or the outer surface of the wall. Particularly, the vapor barrier can be positioned on the surface of the inhalable substance medium wall that is adjacent to the electrical heating member when the inhalable substance medium is heated.

The inhalable substance medium may be attached to the cartridge body only at the ends of the inhalable substance medium. In this manner, the inhalable substance medium can be characterized as being tensioned within the cartridge. The volume of the annular space between the outer surface of the inhalable substance medium wall and the inner surface of the cartridge body wall can be about 5 ml to about 100 ml, and can provide a dynamic head space that provides for passage of a combination of aerosol and air that substantially corresponds to an average puff volume desired to deliver a desired amount of the inhalable substance (i.e., in the form of the aerosol). Moreover, the attachment of the inhalable substance medium to the engaging end of the cartridge body can be configured to facilitate movement of air into the annular space so as to direct the aerosol and the inhalable substance through the mouth end of the article for inhalation by a consumer.

The receiving chamber of the control housing can be defined by a wall with an inner surface and an outer surface, the wall having a cross-section that is substantially similarly shaped to the cross-section of the cartridge. The chamber wall also can include one or more openings therein for allowing entry of ambient air into the chamber and thus facilitate movement of the inhalable substance out of the annular space, as described above. Alternatively, the chamber may be absent from the receiving end of the control housing or may be replaced with one or more guide components (e.g., extensions of the casing of the control housing) that guide the cartridge into a proper alignment with the control housing. In some embodiments, the walls defining the chamber may be characterized as examples of a guide component. Thus, the guide component could be substantially similar in dimensions with the chamber walls.

The electrical energy source can essentially be a receptacle that provides for transmission of electrical current from the power source to the heating member. In specific embodiments, the electrical energy source can include a projection that extends from the control housing (e.g., through the receiving chamber, and preferably approximately to the open end of the chamber). When the electrical heating member is a component part of the control housing, the electrical heating member may be specifically attached to this projection on the electrical energy source. In such embodiments, the heating member can include electrical contacts that extend from the heating member and insert into the receptacle in the electrical energy source. This can be a permanent, non-removable connection of the contacts into the receptacle.

The heating member can specifically be a resistance wire that generates heat as an electrical current passes therethrough. In specific embodiments, the heating member may be integral to the inhalation substance medium.

In specific embodiments, the heating member can comprise multiple components. For example, the heating member may comprise a resistance wire of substantially small dimensions, and a heat spreading member may be associated therewith to spread the generated heat across a wider area.

The electrical heating member (or the heat spreading member) particularly may be present on the projection only along a segment of defined length, and such segment particularly may be in proximity to the end of the projection at the open end of the chamber. The segment of defined length may encompass about 5% to about 50% of the length of the projection. In this manner, segmented heating can be provided in that the heating member will only encompass an area of the inhalable substance medium that is less than the entire length of the medium. Preferably, the heating member (or the heat spreading member) encompasses a length of about one-sixth to about one-tenth of the inhalable substance medium whereby the medium can be completely used in about six to about 10 segments or puffs. To achieve this, the cartridge may specifically index past the projection segment having the electrical heating member present thereon. Such indexing can be manually controlled by a consumer, such as using a push-button to advance the cartridge within the receiving chamber or by simply tapping on the cartridge. In specific embodiments, the article can comprise a puff actuated switch that automatically indexes the cartridge past the projection segment. Thereby, the distance traveled by the cartridge during indexing can be directly related to the duration of the puff.

In other embodiments, the electrical heating member still may be positioned in the control housing, but the article may provide for bulk heating of the inhalable substance medium rather than segmented heating. For example, the electrical heating member (or the heat spreading member) may be present on the projection along a segment that is about 75% to about 125% the length of the inhalable substance medium. In this manner, the cartridge is inserted substantially completely into the receiving chamber for the duration of use, and each puff on the article heats the entire (or almost entire) length of the inhalable substance medium. Electrical contacts present on the heating member permanently engage the receptacle (i.e., the electrical energy source) so that electrical current can be delivered to the heating member. When the chamber walls are absent, the cartridge can be characterized as being combined with the control housing such that the projection is inserted substantially into the inhalable substance to the full extent allowed by the specific structure thereof.

In other embodiments, the heating member can be a component part of the cartridge rather than the control housing. Such configuration can allow for bulk heating of the inhalable substance medium. Specifically, the heating member can be present along substantially the entire length of the inhalable substrate medium and can include electrical contacts that engage the receptacle in the electrical energy source. When heating is activated, heating occurs along the entire length of the electrical heating member. Specifically, the electrical heating member (or the heat spreading component) may be present within the cartridge along a segment that is about 75% to about 100% the length of the inhalable substance medium.

Segmented heating also can be provided when the heating member is present within the cartridge. To achieve such segmented heating, it is preferably for the projection of the electrical energy source to include electrical leads in proximity to the end of the projection at the open end of the chamber. The electrical leads form an electrical connection with discrete segments of the electrical heating member such that when heating occurs, only the portion of the inhalable substance medium in proximity to the segment of the electrical heating member in electrical connection with the projection is heated. The segment of the electrical heating member that is in electrical connection with the electrical leads of the projection can encompass about 5% to about 50% of the length of the inhalable subject medium. Aspects of the invention described above in relation to the article generally may apply to any of the embodiments, such as the use of puff actuated indexing.

Segmented heating also may be provided by other heating means. For example, a plurality of heating members may be positioned in relation to the inhalable substance medium such that only a specific segment of the inhalable substance medium is heated by a given heating member. The plurality of heating members may be components of the control housing or the cartridge, and the plurality of heating members may be specifically coated with the inhalable substance. Moreover, a bulk heater structure may be provided but can be adapted for electronic control such that only specific segments of the bulk heater are powered at a given time to heat only specific segments of the inhalable substance medium.

The control housing may include further components necessary for function of the article. Specifically, the control housing can include switching components for actuating flow of electrical current from the electrical energy source to the heating member upon application of proper stimulus. Such actuation can be manual (e.g., use of a pushbutton) or automatic (e.g., puff actuated heating). In specific embodiments, actuation initiates uninterrupted current flow to quickly heat the heating member.

The article preferably includes further components for controlling current flow. This may include time-based control wherein current is allowed to flow for a defined period of time prior to deactuation of the current flow. Such time-based regulation can include periods of cycling wherein the current flow is rapidly actuated and deactuated to maintain the heater at a defined temperature. In other embodiments, once a defined temperature is achieved, the current regulator may deactuate the current flow until a new puff initiates actuation again. The actuation and deactuation achieved by the switching components preferably provide for a working temperature for the heating member of about 120° C. to about 300° C.

The control housing still further includes an electrical power source to provide power to the electrical energy source. Such power source may include one or more batteries and/or at least one capacitor (or other means for providing a stored source of power).

In other embodiments, the general components of the article may exist separately. For example, the invention provides a disposable unit for use with a reusable smoking article. Such disposable unit may generally comprise any of the subject matter described herein in relation to the cartridge.

In specific embodiments, a disposable unit for use with a reusable smoking article can comprise a substantially tubular shaped cartridge body having an engaging end configured to engage the reusable smoking article, an opposing mouth end configured to allow passage of an inhalable substance to a consumer, and a wall with an outer surface and an inner surface that defines an interior cartridge space that includes a substantially tubular shaped inhalable substance medium having a wall with an inner surface and an outer surface so as to define an annular space of a specified volume between the outer surface of the inhalable substance medium wall and the inner surface of the cartridge body wall, the inhalable substance medium having a first end in proximity to the mouth end of the cartridge and having a second end in proximity to the engaging end of the cartridge. The disposable unit further can comprise an electrical heating member that heats at least a segment of the inhalable substance medium sufficiently to form a vapor comprising the inhalable substance within the annular space. The electrical heating member further can comprise contacts for making electrical connection with an electrical energy source in the reusable smoking article. Moreover, the electrical heating member can be positioned within the tubular shaped inhalable substance medium and, preferably, is in direct contact with the inhalable substance medium. In certain embodiments, the vapor barrier may include components so as to function has an electrical heating member as well. The disposable unit further can comprise an overwrap that surrounds the cartridge body and which can extend beyond the engaging end of the cartridge body (e.g., by a distance that is about 10% to about 90% of the length of the cartridge body). The overwrap also can include a filter material positioned in proximity to the mouth end of the cartridge body.

Likewise, the invention provides a reusable control unit that can be used with a disposable smoking article. Such reusable control unit may generally comprise any of the subject matter described herein in relation to the control housing.

In specific embodiments, a reusable control unit for use with a disposable smoking article can comprise a control housing including: a receiving end for receiving an engaging end of the disposable smoking article and including an electrical energy source that delivers power to an electrical heating member, the electrical energy source including a projection that extends outward from the receiving end of the control housing and including a component that forms an electrical connection with electrical contacts on the electrical heating member; and a control unit section that houses a power source, a switching component that actuates flow electrical current from the electrical energy source to the heating member, and a flow regulating component that regulates a previously initiated current flow from the electrical energy source to the electrical heating member. The receiving end particularly can include a receiving chamber defined by walls that surround the projection. Exemplary power sources can include a battery and/or at least one capacitor. The switching component can comprise a puff-actuated switch or may comprise a pushbutton. The current regulating component specifically can be a time-based component. As such, the current regulating component may stop current to the electrical heating member once a defined temperature has been achieved. Further, the current regulating component may cycle the current to the electrical heating member off and on once a defined temperature has been achieved so as to maintain the defined temperature for a defined period of time. The component that forms an electrical connection with the electrical contacts may be a receptacle that is housed in the electrical energy source. Alternatively, the component that forms an electrical connection with the electrical contacts may be located on the projection.

In another aspect, the invention also relates to kits that can provide various components of the inventive article, and accessories therefor, in a variety of combinations. Specifically, individual kits may include any combination of one or more cartridges, one or more control units, one or more heating members, one or more batteries, and one or more charging components. The kit may include packaging, (e.g., a case or similar item) that can store one or more of the components of the kit. Particularly, the case may be sized for carrying in the pocket of a consumer (e.g., sized to fit in a typical shirt pocket, trouser pocket, or jacket pocket). The case may be hard or soft, depending upon the components of the kit. The case also may be a storage mechanism that can function as a charging station for the inventive article.

BRIEF DESCRIPTION OF THE DRAWINGS

In order to assist the understanding of embodiments of the invention, reference will now be made to the appended drawings, in which like reference numerals refer to like elements and which are not necessarily drawn to scale. The drawings are exemplary only, and should not be construed as limiting the invention.

DETAILED DESCRIPTION

Figure 1:
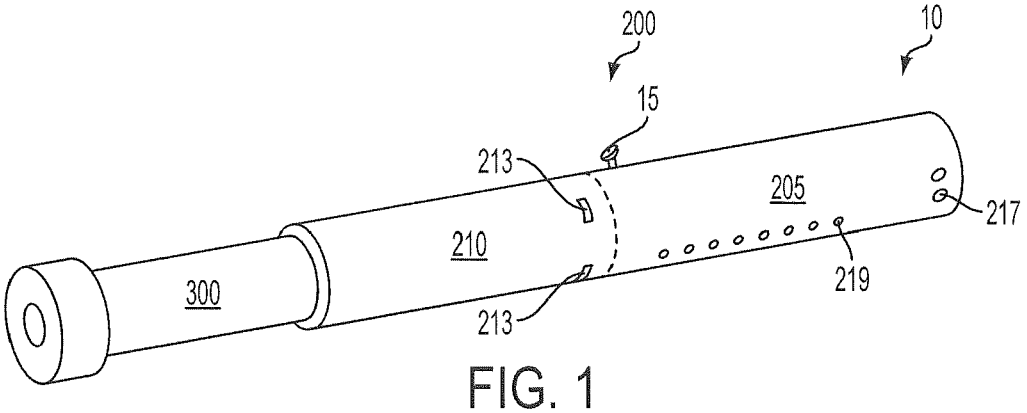
FIG. 1 is a perspective view of an article according to an embodiment of the invention comprising a cartridge engaging a control housing, wherein the cartridge is inserted only a minimum distance into the control housing.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. It must be noted that, as used in this specification, the singular forms "a," "an," and "the" include plural referents unless the context clearly dictates otherwise.

The present invention provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without the actual combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article in a hand, drawing on one end of the article, and inhaling from the article. In further embodiments, the inventive articles can be characterized as being vapor-producing articles, aerosolization articles, or pharmaceutical delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather may depend upon the nature of the medium and the inhalable substance itself as to whether it exists in a vapor state or an aerosol state. In some embodiments, the terms may be interchangeable. Thus, for simplicity, the terms as used to describe the invention are understood to be interchangeable unless stated otherwise.

In one aspect, an article according to the invention generally can comprise an electrical energy source, a heating member powered by the electrical energy source, a control component or control housing related to the delivery of electrical energy from the electrical energy source to the heating member, and an inhalable substance medium that is positionable in proximity to or in direct contact with the heating member. When the heating member heats the inhalable substance medium, an inhalable substance is formed from, released from, or generated from the inhalable substance medium in a physical form suitable for inhalation by a consumer. It should be noted that the foregoing terms are meant to be interchangeable such that reference to release, releasing, releases, or released includes form or generate, forming or generating, forms or generates, and formed or generated. Specifically, the inhalable substance is released in the form of a vapor or aerosol or mixture thereof.

Referring now to the appended figures, an article 10 according to the invention generally can comprise a control housing 200 and a cartridge 300. In specific embodiments, the control housing 200 may be referred to as being reusable, and the cartridge 300 may be referred to as being disposable. In some embodiments, the entire article 10 may be characterized as being disposable in that the control housing 200 may be configured for only a limited number of uses (e.g., until a battery power component no longer provides sufficient power to the article) with a limited number of cartridges 300 and, thereafter, the entire article 10, including the control housing 200, may be discarded. In other embodiments, the control housing 200 may have a replaceable battery such that the control housing 200 can be reused through a number of battery exchanges and with many cartridges 300. Similarly, the article 10 may be rechargeable and thus may be combined with any type of recharging technology, including connection to a typical electrical outlet, connection to a car charger (i.e., cigarette lighter receptacle), and connection to a computer, such as through a USB cable.

Although an article according to the invention may take on a variety of embodiments, as discussed in detail below, the use of the article by a consumer will be similar in scope. In particular, the article can be provided as a plurality of components that are combined by the consumer for use and then are dismantled by the consumer thereafter. Specifically, a consumer may have a reusable control housing that is substantially cylindrical in shape having an open end (or, when chamber walls are absent, a projection end) and an opposing, closed end. The closed end of the control housing may include one or more indicators of active use of the article. The consumer further can have one or more cartridges that engage the open end of the control housing. To use the article, the consumer can insert the cartridge into the open end of the control housing or otherwise combine the cartridge with the control housing so that the article is operable as discussed herein. In some embodiments, the cartridge can be inserted as far into the control housing as allowed by the overall structure of the components. Typically, a portion of the cartridge that is at least sufficiently sized for insertion into the mouth of the consumer for puffing thereon can remain outside of the control housing. This may be referred to as the mouth end of the cartridge.

During use, the consumer initiates heating of a heating member that is adjacent an inhalable substance medium (or a specific layer thereof), and heating of the medium releases the inhalable substance within a space inside the cartridge so as to yield an inhalable substance. When the consumer inhales on the mouth end of the cartridge, air is drawn into the cartridge through openings in the control housing and/or the cartridge itself. The combination of the drawn air and the released inhalable substance is inhaled by the consumer as the drawn materials exit the mouth end of the cartridge into the mouth of the consumer. To initiate heating, the consumer may manually actuate a pushbutton or similar component that causes the heating member to receive electrical energy from the battery or other energy source. The electrical energy may be supplied for a pre-determined length of time or may be manually controlled. Preferably, flow of electrical energy does not substantially proceed in between puffs on the article (although energy flow may proceed to maintain a baseline temperature greater than ambient temperature—e.g., a temperature that facilitates rapid heating to the active heating temperature). In further embodiments, heating may be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded.

In other embodiments, the cartridge may initially only be inserted a short distance into the control housing. During use, the cartridge can be incrementally pushed further into the control housing. The number of such indexes into the control housing can correspond to the number of puffs to be supplied by the individual cartridge. In relation to each puff, the cartridge is indexed further into the control housing. Once the cartridge has been fully indexed into the housing and all puffs have been taken, the cartridge can be removed from the control housing and discarded. The foregoing description of use of the article can be applied to the various embodiments described through minor modifications, which can be apparent to the person of skill in the art in light of the further disclosure provided herein. The above description of use, however, is not intended to limit the use of the inventive article but is provided to comply with all necessary requirements of disclosure of the present invention.

Figure 2:
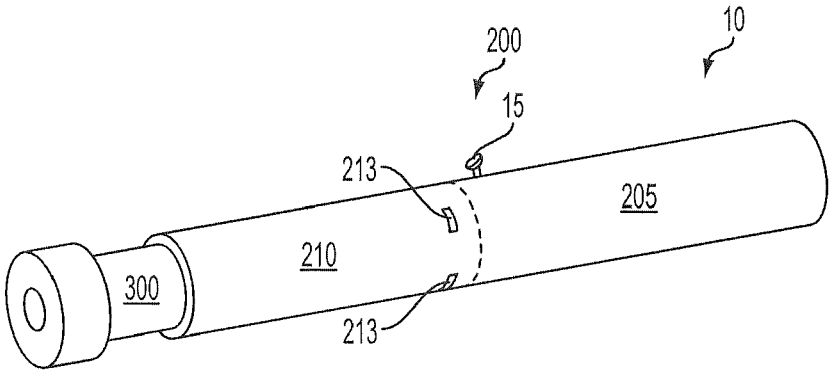
FIG. 2 is a perspective view of the article illustrated in FIG. 1, wherein the cartridge is indexed a further distance into the control housing.
Figure 3:
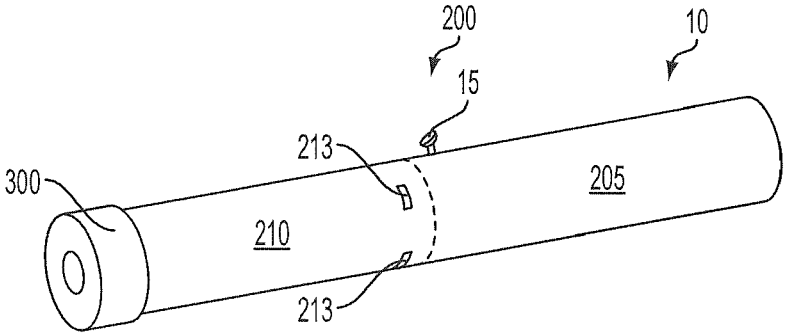
FIG. 3 is a perspective view of the article illustrated in FIG. 1, wherein the cartridge is indexed fully into the control housing.

Turning to the specific embodiments, as seen in the embodiments of FIG. 1 through FIG. 3, an article 10 according to the invention can have an overall shape that may be defined as being substantially rod-like or substantially tubular shaped or substantially cylindrically shaped. In the embodiments of FIG. 1 through FIG. 3, the article 10 has a substantially round cross-section; however, other cross-sectional shapes (e.g., oval, square, triangle, etc.) also are encompassed by the present disclosure. Such language that is descriptive of the physical shape of the article may also be applied to the individual components thereof, including the control housing 200 and the cartridge 300.

The control housing 200 and the cartridge 300 are specifically configured so as to engage one another in a sliding or otherwise indexable manner. As seen in FIG. 1, the cartridge 300 slides into an open end of the control housing 200 such that, during functioning, the cartridge 300 and the control housing 200 are in a coaxial relationship. In such embodiments, the control housing 200 can comprise a control segment 205 and a receiving chamber 210 into which the cartridge 300 is inserted. As will be discussed in greater detail below, FIG. 2 and FIG. 3 illustrate the nature whereby, in some embodiments, the article 10 may become gradually shortened during use by a consumer. Specifically, in certain embodiments, the cartridge 300 can be continually or segmentally indexed into the control housing 200 such that the cartridge 300 is understood to have been completely used once the article 10 has achieved its minimum length. Reverse indexing also may be used. The cartridge 300 may move continuously without predetermined stops at defined positions within the receiving chamber 210. In other embodiments, predetermined stops or predetermined lengths of movement of the cartridge 300 within the receiving chamber 210 can be provided such that indexing of the cartridge 300 results in movement by only the predetermined length. Various indexing means are encompassed by the invention as further discussed herein. In some embodiments, the cartridge 300 can be partially or completely inserted into the control housing 200 at the beginning of use by a consumer. Although indexing is described in relation to the cartridge being gradually shortened, the invention also encompasses embodiments wherein, in use, the cartridge is fully inserted into the control housing, and the cartridge indexes outward therefrom.

Figure 4:
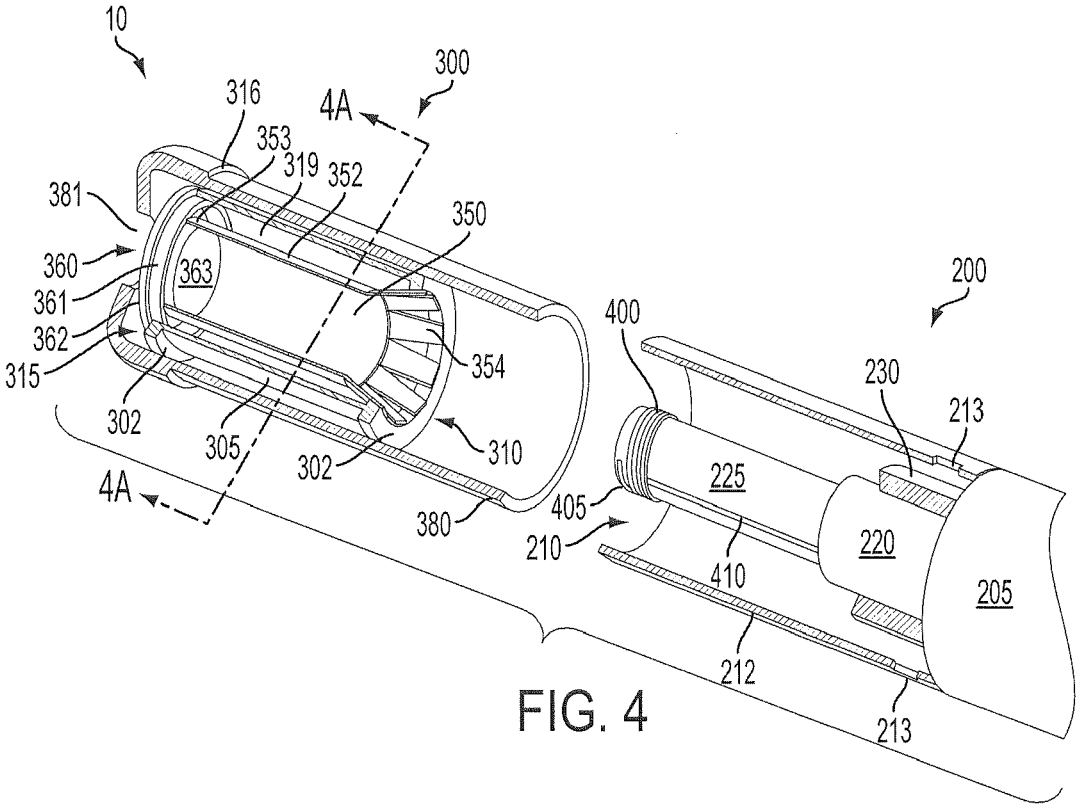
FIG. 4 is a perspective view of a portion of an article according an embodiment of the invention showing a cartridge disengaged from the receiving chamber of a control housing (which is only partially shown), the control housing including a heating member located on a projection to provide for segmented heating of the inhalable substance medium in the cartridge, the cartridge and receiving chamber being partially cut away to reveal the underlying components of the article.
Figure 4A:
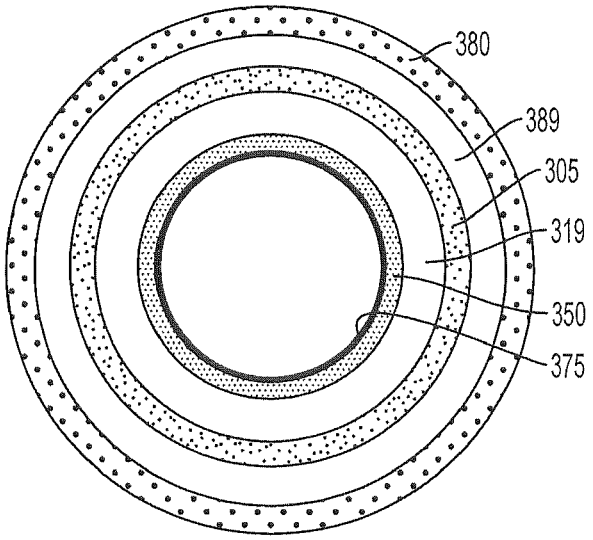
FIG. 4*a* is a cross-section of a cartridge according to an embodiment of the invention, the cross-section being through the plane shown by dashed lines in FIG. 4, the cross-section illustrating the spatial relationship and configuration of certain components of the cartridge.

An article 10 according to the invention can be further described in relation to the specific embodiment shown in FIG. 4 wherein a portion of the article is cut away to reveal the interior components of the cartridge 300 and the receiving chamber 210 of the control housing 200. The cartridge 300 comprises a cartridge body 305 formed of a wall having an outer surface and an inner surface and providing the cartridge body 305 with a substantially tubular shape. The cartridge body 305 has opposing terminal ends that define an engaging end 310 that engages the receiving chamber 210 of the control housing 200 and a mouth end 315 configured to allow passage of an inhalable substance to a consumer. Although not required, it can be beneficial for the wall of the cartridge body 305 to be reinforced at one or both of the terminal ends, such as with the flanges 302 illustrated in FIG. 4. When an overwrap 380 is present, the presence of the flanges can provide for a dead space 389 between the cartridge and the overwrap (as illustrated in FIG. 4*a*).

The cartridge body 305 can be formed of any material suitable for forming and maintaining an appropriate conformation, such as a tubular shape, and for retaining therein an inhalable substance medium 350. The cartridge body 305 can be fowled of a single wall, as shown in FIG. 4*a*. In some embodiments, the cartridge body 305 is formed of a material (natural or synthetic) that is heat resistant so as to retain its structural integrity—e.g., does not degrade—at least at a temperature that is the heating temperature provided by the electrical heating member, as further discussed herein. In some embodiments, a heat resistant polymer may be used. In other embodiments, the cartridge body 305 may be formed from paper, such as a paper that is substantially straw-shaped. As further discussed herein, the cartridge body 305, such as a paper tube, may have one or more layers associated therewith that function to substantially prevent movement of vapor therethrough. In one example, an aluminum foil layer may be laminated to one surface of the cartridge body. Ceramic materials also may be used. In further embodiments, an insulating material may be used so as not to unnecessarily move heat away from the inhalable substance medium. The cartridge body 305, when formed of a single layer, may have a thickness that preferably is about 0.2 mm to about 5.0 mm, about 0.5 mm to about 4.0 mm, about 0.5 mm to about 3.0 mm, or about 1.0 mm to about 3.0 mm. Further exemplary types of components and materials that may be used to provide the functions described above or be used as alternatives to the materials and components noted above can be those of the types set forth in US Pub. Nos. 2010/00186757 to Crooks et al.; 2010/00186757 to Crooks et al.; and 2011/0041861 to Sebastian et al.; the disclosures of the documents being incorporated herein by reference in their entireties.

The inner surface of the wall of the cartridge body 305 defines an interior cartridge space, and an inhalable substance medium 350 is included within said space. The inhalable substance medium 350 can be any material that, when heated, releases an inhalable substance, such as a flavor-containing substance. In the embodiment of FIG. 4, the inhalable substance medium 350 is a solid substrate comprising the inhalable substance. The inhalable substance specifically may be a tobacco component or a tobacco-derived material (i.e., a material that is found naturally in tobacco that may be isolate directly from the tobacco or synthetically prepared). For example, the inhalable substance medium can comprise tobacco extracts or fractions thereof combined with an inert substrate. The inhalable substance medium further may comprise unburned tobacco or a composition containing unburned tobacco that, when heated to a temperature below its combustion temperature, releases an inhalable substance. Although less preferred, the inhalable substance medium may comprise tobacco condensates or fractions thereof (i.e., condensed components of the smoke produced by the combustion of tobacco, leaving flavors and, possibly, nicotine).

Tobacco materials useful in the present invention can vary and can include, for example, flue-cured tobacco, burley tobacco, Oriental tobacco or Maryland tobacco, dark tobacco, dark-fired tobacco and *Rustica* tobaccos, as well as other rare or specialty tobaccos, or blends thereof. Tobacco materials also can include so-called "blended" forms and processed forms, such as processed tobacco stems (e.g., cut-rolled or cut-puffed stems), volume expanded tobacco (e.g., puffed tobacco, such as dry ice expanded tobacco (DIET), preferably in cut filler form), reconstituted tobaccos (e.g., reconstituted tobaccos manufactured using paper-making type or cast sheet type processes). Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,011,096 to Li et al.; and U.S. Pat. No. 7,017,585 to Li et al.; U.S. Pat. No. 7,025,066 to Lawson et al.; US Pat. App. Pub. No. 2004-0255965 to Perfetti et al.; PCT WO 02/37990 to Bereman; and Bombick et al., *Fund. Appl. Toxicol.,* 39, p. 11-17 (1997); which are incorporated herein by reference. Further exemplary tobacco compositions that can be useful in a smoking device, including according to the present invention, are disclosed in U.S. Pat. No. 7,726,320 to Robinson et al., which is incorporated herein by reference in its entirety.

Still further, the inhalable substance medium 350 may comprise an inert substrate having the inhalable substance, or a precursor thereof, integrated therein or otherwise deposited thereon. For example, a liquid comprising the inhalable substance may be coated on or absorbed or adsorbed into the inert substrate such that, upon application of heat, the inhalable substance is released in a form that can be withdrawn from the inventive article through application of positive or negative pressure.

In addition to the inhalable substance (e.g., flavors, nicotine, or pharmaceuticals generally), the inhalable substance medium can comprise one or more aerosol-forming or vapor-forming materials, such as a polyhydric alcohol (e.g., glycerin, propylene glycol, or a mixture thereof) and/or water. Representative types of aerosol forming materials are set forth in U.S. Pat. No. 4,793,365 to Sensabaugh, Jr. et al.; and U.S. Pat. No. 5,101,839 to Jakob et al.; PCT WO 98/57556 to Biggs et al.; and *Chemical and Biological Studies on New Cigarette Prototypes that Heat Instead of Burn Tobacco*, R. J. Reynolds Tobacco Company Monograph (1988); which are incorporated herein by reference. A preferred aerosol forming material produces a visible aerosol upon the application of sufficient heat thereto, and a highly preferred aerosol forming material produces an aerosol that can be considered to be "smoke-like." Further tobacco materials, such as a tobacco aroma oil, a tobacco essence, a spray dried tobacco extract, a freeze dried tobacco extract, tobacco dust, or the like may be combined with the vapor-forming or aerosol-forming material. It is also understood that the inhalable substance itself may be in a form whereby, upon heating, the inhalable substance is released as a vapor, aerosol, or combination thereof. In other embodiments, the inhalable substance may not necessarily release in a vapor or aerosol form, but the vapor-forming or aerosol-forming material that may be combined therewith can form a vapor or aerosol upon heating and function essentially as a carrier for the inhalable substance itself. Thus, the inhalable substance can be characterized as being coated on a substrate, as being absorbed in a substrate, as being adsorbed in a substrate, or as being a natural component of the substrate (i.e., the material forming the substrate, such as a tobacco or a tobacco-derived material). Likewise, an aerosol-forming or vapor-forming material may be similarly characterized. In certain embodiments, the inhalable substance medium particularly may comprise a substrate with the inhalable substance and a separate aerosol forming material included therewith. As such, in use, the substrate can be heated, the aerosol forming material can be volatilized into a vapor form taking with it the inhalable substance. In a specific example, the inhalable substance medium can comprise a solid substrate with a slurry of tobacco and an aerosol-forming material and/or vapor-forming material coated thereon or absorbed or adsorbed therein. The substrate component may be any material that does not combust or otherwise degrade at the temperatures described herein that the heating member achieves to facilitate release of the inhalable substance. For example, a paper material may be used, including a tobacco paper (e.g., a paper-like material comprising tobacco fibers and/or reconstituted tobacco). Thus, in various embodiments, the inhalable substance medium can be characterized as comprising the inhalable substance, alternately as comprising the inhalable substance and a separate aerosol-former or vapor-former, alternately as comprising the inhalable substance and a substrate, or alternately as comprising the inhalable substance medium, the separate aerosol-former or vapor-former, and the substrate. Thus, the substrate may contain one or both of the inhalable substance and the aerosol-former or vapor-former.

If desired, the tobacco material or the inhalable substance medium generally can further include other components, such as sugars, glycerin, vanilla, cocoa, licorice, and other flavoring materials, such as menthol. Exemplary plant-derived compositions that may be used are disclosed in U.S. application Ser. No. 12/971,746 to Dube et al., and Ser. No. 13/015,744 to Dube et al. The selection of such further components can vary based upon factors such as the sensory characteristics that are desired for the present article, and the present invention is intended to encompass any such further components that may be readily apparent to those skilled in the art of tobacco and tobacco-related or tobacco-derived products. See, Gutcho, *Tobacco Flavoring Substances and Methods*, Noyes Data Corp. (1972) and Leffingwell et al., *Tobacco Flavoring for Smoking Products* (1972).

The inhalable substance and/or the separate vapor forming material may be provided on the substrate in a variety of configurations. For example, both materials may be associated with the substrate such that the concentration of each material along the length of the substrate is substantially constant (e.g., when dividing the substrate into a plurality of lengthwise segments, the total concentration of material in each individual segment can be substantially similar, such as varying by less than 10%, less than 5%, or less than 2% by mass). In other embodiments, one or both of the materials may be present in a defined pattern. For example, the pattern may be a gradient wherein the concentration continually increases or decreases along the length of the substrate. In this manner, the first puff on the article may provide an amount of the inhalable substance that is significantly greater than or less than the amount of the inhalable substance in the last puff. Moreover, the pattern may be such that a bolus of inhalable substance is provided at some point along the length of the substrate (e.g., corresponding to the first puff, the last puff, or some intermediate puff on the article). Any variety of such patterns may be envisioned in light of the present disclosure, and such variations are likewise encompassed by the present invention. Such patterning likewise may apply to further components as described herein (e.g., flavorants). For example, a bolus of a flavorant may be provided on the substrate in a position to substantially correspond to the last puff or the last two or three puffs on the article. The release of such flavor may signal to the consumer that the final puff on the device is approaching or has been achieved.

Still further, release of the inhalable substance (and any further components, such as flavorants) may be associated with activation of specific heating member. For example, a plurality of heating members may be provided, and at least two different inhalable substances may be individually associated with two different heating members. In a non-limiting example, ten heating members may be provided; nine of the heating members may be associated with a first inhalable substance (e.g., a tobacco component); and one of the heating members may be associated with a specific flavorant (e.g., menthol). Alternately, two heating members may be provided; the first heating member may provide heating of an inhalable substance medium for release of aerosol sufficient for about six to about ten puffs by a consumer; the second heating member may provide heating to a second inhalable substance medium for release of aerosol sufficient for about one or two puffs. Further combinations of individual heating elements with different inhalable components also are encompassed. If desired, the inventive article can be equipped with a user controlled switching mechanism (or even a preprogrammed mechanism for automatic switching) to allow two or more selected heating members to be activated at essentially the same time to provide an aerosol with the sensory components associated with the respective heating members. For example, one or more flavors may be associated with individual heating members so that a consumer may obtain aerosol of a different flavor during individual puffs on the article.

In specific embodiments, it can be particularly preferable for the inhalable substance medium to comprise a solid substrate and have a high surface area to volume ratio. This can be particularly beneficial to simultaneously increase the volume of vapor or aerosol that can be released from the substrate and into an air flow and lower the temperature required to provide the desired release volume without requiring a high thermal conductivity material as the substrate. Moreover, increased surface area allows for a larger area of contact of the substrate with the heating member, which in turn allows for lower heating temperatures. More particularly, increases in surface area can facilitate aerosol formation at lower vapor pressures, thereby allowing the desired amount of aerosol to be formed at lower temperature, which can correlate to a reduced energy requirement and less potential to form unwanted byproducts of heat decomposition. In particular embodiments, increased surface area can be provided through use of substrates having a high porosity and/or having a convoluted surface profile.

The substrate also may particularly be characterized in relation to thickness. Preferably, the substrate is relatively thin so as to facilitate rapid heat transfer from the heating member to the inhalable substance to be volatilized. For example, the substrate may have an average thickness of less than 5 mm, less than 3 mm, less than 2 mm, less than 1 mm, less than 0.75 mm, or less than 0.5 mm.

In the embodiment of FIG. 4, the inhalable substance medium 350 is substantially tubular shaped and is formed of a wall 352 with an inner surface and an outer surface. As noted above, the substrate wall 352 may be formed substantially of a material that can include the inhalable substance naturally therein (e.g., tobacco paper) or may be formed of any further material (e.g., paper) that can have the inhalable substance and/or the vapor-former or aerosol-former entrained therein. In addition to the inhalable substance and/or the vapor-forming or aerosol-forming substance, the substrate wall may comprise additional components. For example, a vapor barrier 375 may be included on the inner surface of the wall of the inhalable substance medium (as illustrated in FIG. 4*a*) to prevent release of vapor or aerosol into the interior volume of the inhalable substance medium and facilitate release of the vapor or aerosol into an annular space 319 defined by the outer surface of the inhalable substance medium wall 352 and the inner surface of the wall of the cartridge body 305. Such annular space can encompass a portion of the interior cartridge space. Any vapor barrier material, such as a metal foil, may be used. Alternatively, the vapor barrier may be on the outer surface of the inhalable substance medium wall 352 in embodiments where the heating member contacts the outer surface as opposed to the inner surface of the inhalable substance medium wall 352. Preferably, the vapor barrier is positioned on the wall surface that is adjacent (or in contact with) the heating member when the inhalable substance medium 350 is heated. In particular embodiments, the vapor barrier may be formed of a material that is electrical insulating or may comprise a layer of electrically insulating material that can be in contact with the heating member 400. For example, a metal foil may be used as the vapor barrier, and the foil may have an insulating monolayer—e.g., a metal oxide layer—in contact with the heating member.

In further embodiments, the inhalable substance medium may be formed of a material that softens or changes phase (especially from solid to molten) at about the working temperature of the article. For example, the inhalable substance medium may be a wax or a gel, and the inhalable substance may be entrained therein. In such embodiments, it can be particularly useful to include the vapor barrier (or similar material) that provides support to the inhalable substance medium and substantially prevents the inhalable substance medium from contacting the heating member. Likewise, the inhalable substance medium may comprise a vapor barrier layer coated with an inhalable substance and/or an aerosol forming material. For example, one or more of such coating materials may be in a microencapsulated form that preferably releases its components at a temperature within one or more of the working ranges otherwise described herein. Microencapsulation technology that may be useful in such embodiments is disclosed, for example, in U.S. Pat. No. 4,464,434 to Davis.

Figure 4B:
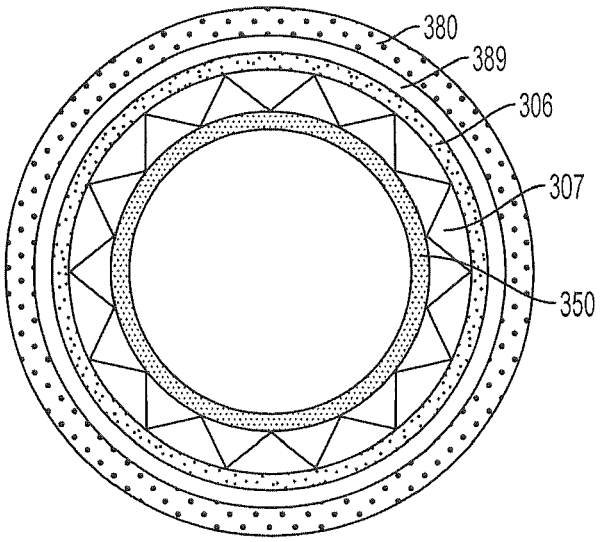
FIG. 4*b* is a cross-section of an alternate embodiment of a cartridge according to the invention, the cross-section being through the plane shown by dashed lines in FIG. 4, the cross-section illustrating the spatial relationship and configuration of certain components of the cartridge.

In alternative embodiments (such as shown in FIG. 4*b*), the cartridge body 305 may be formed with multiple layers. For example, FIG. 4*b* illustrates an alternate embodiment wherein the cartridge body is formed of a first, outer layer 306 formed of a first material and a second, inner layer 307 formed of the same or a different material. Further layers also are envisioned. Preferably, the first, outer layer 306 is formed of a material with a closed structure. By closed structure is meant that the material substantially prevents passage of aerosol or vapor into the interior of the layer such that the aerosol or vapor may propagate along the length of the cartridge body 305 to the mouth end 315 thereof. For example, the first, outer layer 306 may comprise a paper material or a suitable polymer material, as already described above. Such first, outer layer may have a thickness that preferably is less than about 1 mm, less than about 0.9 mm, less than about 0.8 mm, less than about 0.7 mm, less than about 0.6 mm, or less than about 0.5 mm. Alternatively, the first, outer layer may have a thickness of about 0.1 mm to about 1.0 mm, about 0.2 mm to about 0.8 mm, about 0.25 mm to about 0.75 mm, or about 0.3 mm to about 0.7 mm.

The second, inner layer 307 preferably has a greater thickness than the first, outer layer 306, and can be about 0.8 mm to about 4 mm, about 1 mm to about 3.5 mm, or about 1.2 mm to about 3.0 mm. The second, inner layer may be in direct contact with the tobacco substrate material 350. As such, it is preferable for the second, inner layer to have a substantially open structure. By being in direct contact, the second, inner layer may provide greater support to the inhalable substance medium 350. Thus, the cartridge body, and particularly the second, inner layer 307 thereof, may be characterized as providing continuous support for the inhalable substance medium 350 along substantially the entire length thereof (e.g., at least about 75%, at least about 85%, at least about 90%, or at least about 95% of the length thereof). By having an open structure, the second, inner layer can permit passage of formed aerosol or vapor from the inhalable substance medium, and the open structure preferably extends along the length of the cartridge body to the mouth end 315 thereof. In this manner, the annular space 319 defined by the inner surface of the cartridge body and the outer surface of the inhalable substance medium, as other wise described herein, is replaced by the open structured second, inner layer of the cartridge body and provides the same function. Thus, the void in the second, inner layer of the cartridge may exhibit substantially the same characteristics as otherwise described herein (e.g., volume, etc.) for the annular space. In specific embodiments, the open structure of the second, inner layer is such that at least about 50%, at least about 60%, at least about 70%, at least about 80%, or at least about 85% of the layer, based on volume, is the open void space. In specific embodiments, the open space of the second, inner layer may be about 50% to about 90%, about 60% to about 85%, or about 65% to about 80% by volume of the second, inner layer. This relatively thick and porous layer can be characterized as providing an aerosol collection/generation area and may be, in one example, an accordion layer of paper or polymeric material. Alternately, the second, inner layer may be a porous mat of material such as cellulose acetate tow, cotton fibers, or any number of materials useful to form a non-woven porous mat such as spun bonded polypropylene, PLA fibers, PHA fibers, glass fibers, and the like. This may be described as an open cell material.

Figure 4C:
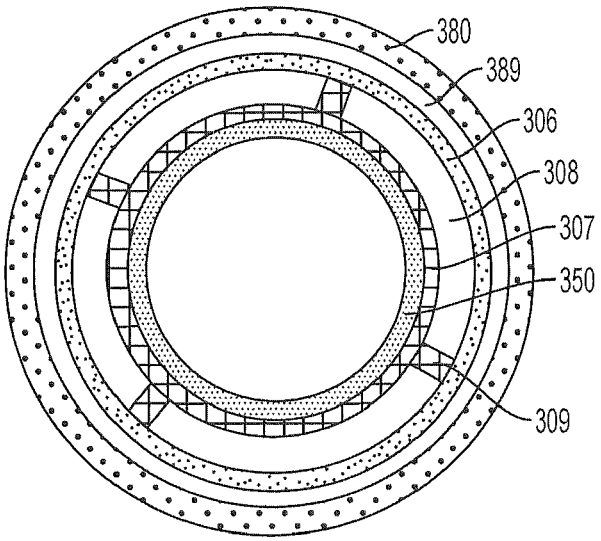
FIG. 4*c* is a cross-section of a further alternate embodiment of a cartridge according to the invention, the cross-section being through the plane shown by dashed lines in FIG. 4, the cross-section illustrating the spatial relationship and configuration of certain components of the cartridge.

In further embodiments, as seen in FIG. 4*c*, the cartridge body may be formed of a first, outer layer 306 that is substantially closed in structure and a second, inner layer 307 that exhibits an open structure, as described above, and the two layers may be separated by a void space 308 as otherwise described herein. In this manner, the inhalable substance medium 350 is provided substantially continuous support, the generated vapor or aerosol is allowed to pass therethrough into the void 308, and the vapor or aerosol can pass along the length of the void to the mouth end 315 of the cartridge body without substantially permeating through the first, outer layer. The void space may include one or more struts 309 interconnecting the first, outer layer with the second, inner layer without limiting passage of any aerosol or vapor along the length of the cartridge body within the void space.

Figure 5:
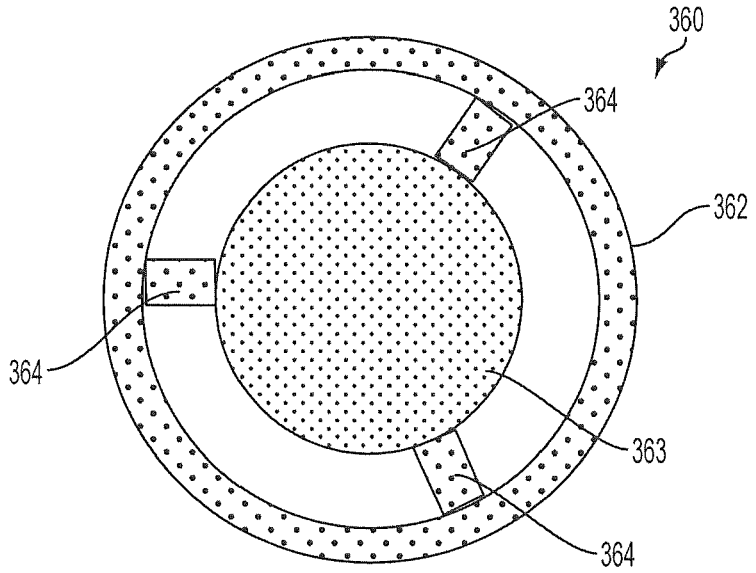
FIG. 5 is a front, plan view of the cartridge frame member from the mouth end of the cartridge from FIG. 4, the frame member being illustrated separate from the cartridge to show components thereof in detail.

As with the cartridge 300 generally, the tubular wall 352 of the inhalable substance medium 350 has opposing terminal ends, the first end 353 being in proximity to the mouth end 315 of the cartridge body 305, and the second end 354 being in proximity to the engaging end 310 of the cartridge body 305. The inhalable substance medium particularly may be attached to the cartridge body at the respective terminal ends of each component. Such attachment may be direct or indirect. For example, in FIG. 4, the second end 354 of the inhalable substance medium 350 is directly attached to the engaging end 310 of the cartridge body 305 (specifically in the area of the flange 302). Such direct attachment can be by any suitable means, such as an adhesive. The first end 353 of the inhalable substance medium 350, however, is indirectly attached to the mouth end 315 of the cartridge body 305 via a frame member 360. In this embodiment, the frame member 360 comprises an outer wall 361, a wall flange 362, a central hub 363, and a plurality of spokes 364 connecting the central hub 363 to the outer wall 361 such that open space exists between the outer wall 361 and the central hub 363. For clarity, FIG. 5 provides an end view of the cartridge (without overwrap 380), and this view essentially shows the frame member. The central hub 363 has a cross-sectional shape that is substantially identical to the cross-sectional shape of the inhalable substance medium (i.e., round in the present embodiment), and the hub has an outer diameter of a size suitable such that hub is secured within the first end 353 of the inhalable substance medium, the wall 352 of the inhalable substance medium at the first end being in direct contact with the hub and, preferably, being secured thereto (e.g., by an adhesive or similarly suitable attachment). The hub specifically may have an elongate outer wall that provides sufficient area for attachment for the inhalable substance medium and for attachment to the spokes 364. The hub may have a thickness that is substantially equal to the length of the elongate wall, or the elongate wall may have a length that is greater than the thickness of the hub, the additional length extending one or both of anterior and posterior to the body of the hub. In this manner, the inhalable substance medium is suspended within the cartridge body and is maintained therein through tension along the length of the tubular shaped inhalable substance medium originating from the attachments at the first end and second end thereof to the mouth end 315 and engaging end 310, respectively, of the cartridge body.

Tensioning of the inhalable substance medium can be particularly useful to provide for specific performance of the inventive article. As otherwise described herein, it can be beneficial for the inhalable substance medium to have a relatively small thickness such that heat is efficiently transferred, particularly when substrates, such as paper, that exhibit relatively low heat transfer are used. Substrates of small thickness, however, can have relatively low strength in certain dimensions while exhibiting relatively high strength in other dimensions. For example, thin paper, in tension, exhibits high strength relative to the strength of the same paper in compression. Tensioning also can facilitate direct contact of the heating member to the surface of the inhalable substance medium to be heated (including a substrate that is used or a vapor barrier that may be present). This further can be facilitated by providing the heating member with an outer diameter that is greater than the inner diameter of the inhalable substance medium tube so that the heating member actually provides tension to the inhalable substance medium substantially perpendicularly to the lengthwise axis of the inhalable substance medium. Specifically, the outer diameter of the heating member may exceed the inner diameter of the inhalable substance medium (or the inner diameter of any further layer, such as a vapor barrier, that is interior thereto) by about 1% to about 20%, about 2% to about 15%, about 3% to about 12%, or about 5% to about 10%.

As discussed above, the engaging end 310 of the cartridge 300 is sized and shaped for insertion into the control housing 200. The receiving chamber 210 of the control housing 200 can be characterized as being defined by a wall 212 with an inner surface and an outer surface, the inner surface defining the interior volume of the receiving chamber. Thus, the greatest outer diameter (or other dimension depending upon the specific cross-sectional shape of the embodiments) of the cartridge 300 preferably is sized to be less than the inner diameter (or other dimension) at the inner surface of the wall of the open end of the receiving chamber in the control housing. Ideally, the difference in the respective diameters is sufficiently small so that the cartridge fits snugly into the receiving chamber, and frictional forces prevent the cartridge from being moved without an applied force. On the other hand, the difference should be sufficient to allow the cartridge to slide or otherwise be indexed within the receiving chamber without requiring undue force. In alternative embodiments, the article 10 may be configured such that the cartridge (or a portion thereof) slides over and around the receiving chamber of the control housing. For example, the cartridge may be configured such that the cartridge overwrap 380 has an inner diameter that is greater than the outer diameter of the control housing at the end of the receiving chamber. In this manner, the cartridge overwrap slides over the control housing but further components of the cartridge still can be considered as being inserted into the receiving chamber of the control housing.

In preferred embodiments, the article 10 may take on a size that is comparative to a cigarette or cigar shape. Thus, the article may have a diameter of about 5 mm to about 25 mm, about 5 mm to about 20 mm, about 6 mm to about 15 mm, or about 6 mm to about 10 mm. Such dimension may particularly correspond to the outer diameter of the control housing 200. Thus, the outer diameter of the cartridge 300 can be sufficiently less so as to allow for indexing of the cartridge within the receiving chamber 210, as discussed herein. As seen in FIG. 4, the overwrap 380 of the cartridge may be formed to have an area of increased diameter at the mouth-end 315. This area of increased diameter preferably is such that the diameter is at least the diameter of the receiving end of the control housing. Thus, a mouth-end wall 316 is formed to function as a stop to prevent the cartridge from being inserted entirely into the receiving chamber of the control housing.

The mouth-end wall may define the mouth-end of the cartridge as the distance therefrom to the terminal mouth-end of the cartridge. This may be the area of greater diameter illustrated in FIG. 4. The length of the mouth-end portion having the area of greater diameter can vary, such as being about 5 mm to about 25 mm, about 8 mm to about 22 mm, or about 10 mm to about 20 mm. This area may include a filter component as otherwise described herein. Moreover, in other embodiments, the mouth-end of the overwrap or cartridge may be substantially of the same diameter of the remaining portion thereof. In such embodiments, the mouth-end could be defined as the section of the cartridge that is not heated in use and on which the consumer's lips would be placed. Further, in such embodiments, a mouth-end wall still may be present to function as a stop. Alternatively, other stop means may be provided, including means interior to the cartridge and/or the receiving chamber of the control housing.

The control housing 200 and cartridge 300 may likewise be characterized in relation to overall length. For example, the control housing may have a length of about 40 mm to about 120 mm, about 45 mm to about 110 mm, or about 50 mm to about 100 mm. The cartridge may have a length of about 20 mm to about 60 mm, about 25 mm to about 55 mm, or about 30 mm to about 50 mm. The length of the control housing may be divided substantially equally between the control segment 205 and the receiving end (which may be defined by the receiving chamber 210, or by the projection 225). Alternatively, one or the other may encompass about 55%, about 60%, about 65%, or about 70% of the total length of the control housing. In other embodiments, the receiving chamber may have a length that is about 70% to about 120%, about 80% to about 110%, or about 85% to about 100% of the length of the cartridge. The projection specifically may have a length of about 10 mm to about 50 mm, about 15 mm to about 45 mm, or about 20 mm to about 40 mm.

The projection may be formed of a variety of materials. In specific embodiments, it can be useful for the projection to be formed of a thermal insulator. This can be desirable so as to maximize heat flow from the heating member to the inhalable substance medium rather than to the projection.

The cartridge overwrap 380 may be formed of any material useful for providing additional structure and/or size to the cartridge body 305. Preferably the overwrap comprises a material that resists transfer of heat, which may include a paper or other fibrous material, such as a cellulose. The overwrap also may be formed of multiple layers, such as an underlying, bulk layer and an overlying layer, such as a typical wrapping paper in a cigarette. The overwrap particularly may comprise a material typically used in a filter element of a conventional cigarette, such as cellulose acetate. When the overwrap is present, the overall length thereof can vary from being substantially identical to the length of the cartridge body (and the inhalable substance medium 350) up to about two times the length of the cartridge body. Thus, the overwrap can be characterized as extending beyond the engaging end 310 of the cartridge body and/or as extending beyond the mouth end 315 of the cartridge body. Thus, the cartridge body and the inhalable substance medium each have a length that is up to about 50%, up to about 30%, or up to about 10% less than the length of the overwrap. Preferably, the cartridge body and the inhalable substance medium each have a length that is at least 10%, at least 15%, or at least 20% less than the length of the overwrap. More specifically, the distance the overwrap extends beyond the engaging end 310 of the cartridge body can be about 5%, about 10%, about 15%, about 20%, about 25%, about 30%, about 40%, about 50%, about 60%, about 70%, about 80%, about 90%, or about 100% of the length of the cartridge body. Further, the distance the overwrap extends beyond the engaging end of the cartridge body can be about 5% to about 100%, about 10% to about 90%, about 15% to about 80%, about 20% to about 75%, about 25% to about 70%, or about 30% to about 60% of the length of the cartridge body. The distance the overwrap extends beyond the mouth end of the cartridge body can be at least about 1%, at least about 2%, at least about 3%, at least about 4%, at least about 5%, at least about 6%, at least about 7%, at least about 8%, at least about 9%, or at least about 10% of the length of the cartridge body. In other embodiments, the distance can be about 2% to about 20%, about 4% to about 18%, or about 5% to about 15% of the length of the cartridge body. The excess length of the overwrap at the engaging end of the cartridge can function to protect the inhalable substance medium within and also to provide structural integrity to the article 10 when the cartridge is inserted into the receiving chamber 210 only to a point wherein the heating member just makes contact with the inhalable substance medium. The excess length of the overwrap at the mouth end of the cartridge can function to simply separate the cartridge body from the mouth of a consumer or to provide space for positioning of a filter material or to affect draw on the article or to affect flow characteristics of the vapor or aerosol leaving the article during draw.

Alternatively, the overwrap may be absent, and the inhalable substance medium may simply be substantially shorter in length than the cartridge body. Similarly, the overwrap and the cartridge body may essentially be combined into a single element that provides the functions of both elements as otherwise described herein. In such embodiments, the annular space 319 wherein the vapor is formed may be the space between the inhalable substance medium and the outer body (i.e., the combined cartridge body and overwrap). For example, referring to FIG. 4, the cartridge body 305 may be absent, and the overwrap 380 can essentially function also as the cartridge body—i.e., the outer body. Specifically, the second end 354 of the inhalable substance medium 350 may be attached directly to the outer body. For example, a ferrule (not shown) may be used to attach the second end of the inhalable substance medium to the outer body. The inhalable substance medium may be perforated so as to allow air flow into the annular space. Alternatively, perforations may be formed in the outer body (or cartridge and/or overwrap, depending upon the particular embodiment) in the area of the annular space. Thus, the invention in all embodiments encompasses the presence of perforations or apertures in the components as necessary to allow ambient air to flow directly into the annular space (e.g., without having to pass through the second end of the inhalable substance medium).

Figure 6:
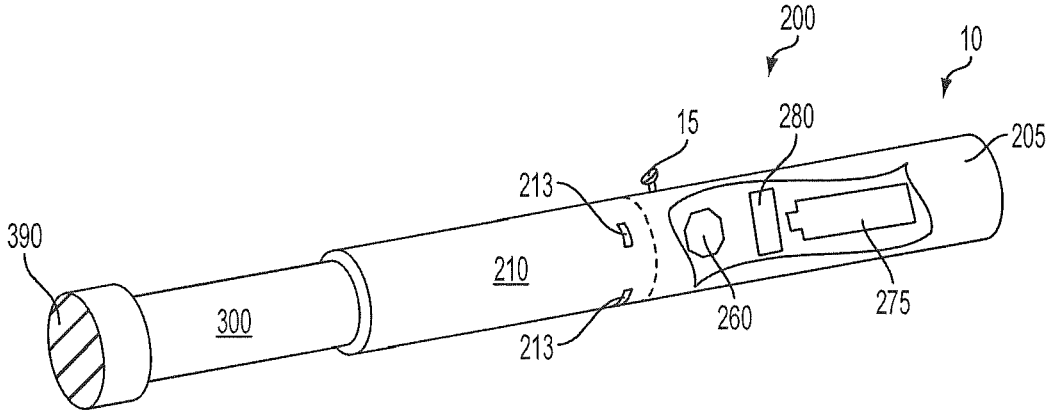
FIG. 6 is a perspective view of an article according to an embodiment of the invention showing a cartridge engaging a control housing, wherein a portion of the exterior of the control housing is removed to reveal interior components thereof.

The overwrap also can function to provide particular characteristics at the mouth end of the cartridge. For example, the construction and/or shape and/or dimension of the overwrap can function to provide the sensation of a conventional cigarette in the mouth of a user. Moreover, the overwrap may comprise a filter 390 (e.g., cellulose acetate or polypropylene) positioned in proximity to the mouth end of the cartridge (such as shown in FIG. 6, wherein the terminus of the mouth end 315 of the cartridge is removed to reveal the filter underneath) to increase the structural integrity thereof and/or to provide filtering capacity, if desired, and/or to provide resistance to draw. For example, an article according to the invention can exhibit a pressure drop of about 50 to about 250 mm water pressure drop at 17.5 cc/second air flow. In further embodiments, pressure drop can be about 60 mm to about 180 mm or about 70 mm to about 150 mm. Pressure drop value may be measured using a Filtrona Filter Test Station (CTS Series) available from Filtrona Instruments and Automation Ltd or a Quality Test Module (QTM) available from the Cerulean Division of Molins, PLC. The thickness of the filter along the length of the cartridge can vary—e.g., about 2 mm to about 20 mm, about 5 mm to about 20 mm, or about 10 mm to about 15 mm. In some embodiments, the filter may be separate from the overwrap, and the filter may be held in position near the cartridge by the overwrap.

Exemplary types of wrapping materials, wrapping material components, and treated wrapping materials that may be used in overwrap 380 in the present invention are described in U.S. Pat. No. 5,105,838 to White et al.; U.S. Pat. No. 5,271,419 to Arzonico et al.; U.S. Pat. No. 5,220,930 to Gentry; U.S. Pat. No. 6,908,874 to Woodhead et al.; U.S. Pat. No. 6,929,013 to Ashcraft et al.; U.S. Pat. No. 7,195,019 to Hancock et al.; U.S. Pat. No. 7,276,120 to Holmes; U.S. Pat. No. 7,275,548 to Hancock et al.; PCT WO 01/08514 to Fournier et al.; and PCT WO 03/043450 to Hajaligol et al., which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. The porosity of the wrapping material can vary, and frequently is between about 5 CORESTA units and about 30,000 CORESTA units, often is between about 10 CORESTA units and about 90 CORESTA units, and frequently is between about 8 CORESTA units and about 80 CORESTA units.

In various embodiments, a wrapping material used in the overwrap 380 can incorporate a fibrous material and at least one filler material imbedded or dispersed within the fibrous material. The fibrous material can vary and can be, for example, a cellulosic material. The filler material can have the form of essentially water insoluble particles. Additionally, the filler material can incorporate inorganic components.

To maximize aerosol and flavor delivery which otherwise may be diluted by radial (i.e., outside) air infiltration through the overwrap 380, one or more layers of non-porous cigarette paper may be used to envelop the cartridge (with or without the overwrap present). Examples of suitable non-porous cigarette papers are commercially available from Kimberly-Clark Corp. as KC-63-5, P878-5, P878-16-2 and 780-63-5. Preferably, the overwrap is a material that is substantially impermeable to the vapor formed during use of the inventive article. If desired, the overwrap can comprise a resilient paperboard material, foil-lined paperboard, metal, polymeric materials, or the like, and this material can be circumscribed by a cigarette paper wrap. Moreover, the overwrap 380 may comprise a tipping paper that circumscribes the component and optionally may be used to attach a filter material to the cartridge 300, as otherwise described herein.

Referring again to FIG. 4, it can be seen that the portion of the overwrap at the mouth end 315 of the cartridge 300 actually extends beyond the end of the cartridge body 305 and includes an opening 381 to allow free movement of vapor and/or aerosol from the article 10 to a consumer. In some embodiments, it may be desirable to include a filter material specifically in this area of the article, such as positioned between the mouth end 315 of the cartridge body 305 and the terminal mouth end of the overwrap 380 (as shown in FIG. 6). Thus, the mouth end of the cartridge may be characterized as being partially occluded (i.e., by the presence of the filter material and/or by the size of the opening). This can be beneficial to limit the concentration of the inhalable substance that is delivered to the consumer or control resistance to draw. Alternatively, any filter material that is used may be designed with relatively low removal efficiency so as not to significantly limit the aerosol delivered therethrough.

The control housing 200 includes an electrical energy source 220 that provides power to the electrical heating member 400. The energy source includes a projection 225 that extends therefrom such that the terminal end of the projection extends approximately to the end of the receiving chamber 210. The electrical energy source is surrounded by a base 230 that can provide insulating properties and also can function as a dead stop to prevent the cartridge 300 from being inserted into the control housing a distance such that the projection extends through the mouth end 315 of the cartridge. The projection is dimensioned to slide inside the interior space defined by the inner surface of the wall 352 of the inhalable substance medium 350. The projection also is dimensioned to provide the electrical heating member in sufficient proximity to the inhalable substance medium (preferably in direct contact therewith) to heat the medium and cause release of the inhalable substance. Thus, the engaging end 310 of the cartridge generally or the cartridge body 305 specifically can be characterized as including an opening that is sufficiently sized and shaped to receive at least one component of the electrical energy source (i.e., the projection 225).

Figure 9:
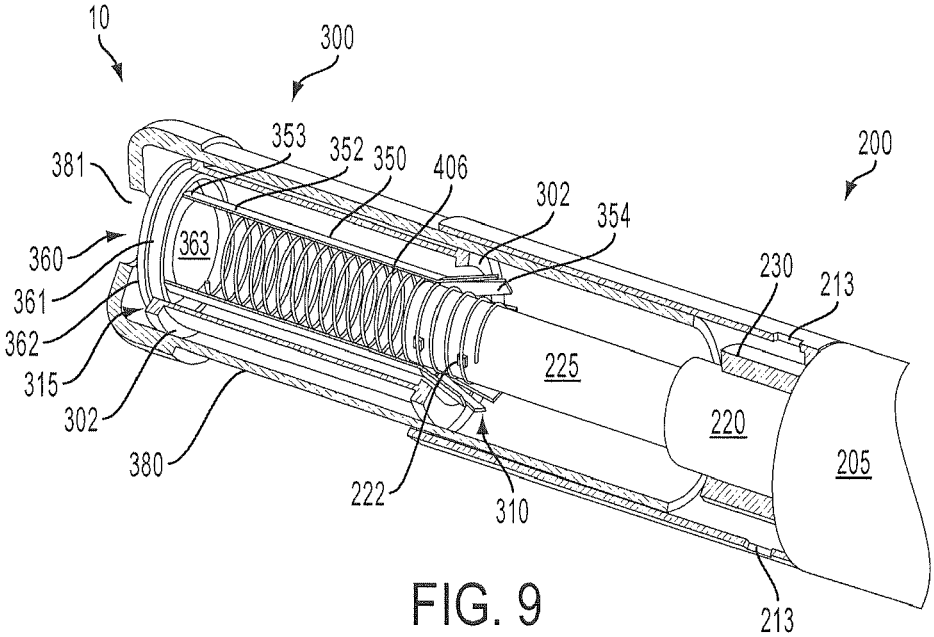
FIG. 9 is a perspective view of a portion of an article according an embodiment of the invention showing a cartridge with a heating member located therein partially engaging the receiving chamber of a control housing (which is only partially shown), the control housing including a projection with electrical leads thereon that interact with the heating member in the cartridge to provide for segmented heating of the inhalable substance medium in the cartridge, the cartridge and receiving chamber being partially cut away to reveal the underlying components of the article.

The electrical energy source 220 can be characterized as being an electrical receptacle that is in electrical connection with a power source 275 (shown in FIG. 6) and that provides for switch-operated delivery of electrical energy to the heating member 400, such as via the contacts 410, as illustrated in FIG. 4. In some embodiments, the contacts may be permanently inserted into the receptacle or electrical energy source 220. In other embodiments, the electrical energy source may function as a more literal receptacle in that the contacts are not permanently inserted therein but only make an electrical connection with the electrical energy source when the cartridge 300 is inserted into the receiving chamber 210 sufficiently so that the contacts are moved into electrical connection with the electrical energy source. In still other embodiments, the projection 225 can function as an extension of the electrical energy source in that electrical leads 222 (as seen in FIG. 9) are present on the projection, and the electrical heating member 400 receives electrical energy from the electrical energy source only when the electrical heating member (or a portion thereof) makes contact with the electrical leads.

The electrical heating member 400 can be any device suitable to provide heat sufficient to facilitate release of the inhalable substance for inhalation by a consumer. In certain embodiments, the electrical heating member is a resistance heating element. Useful heating elements can be those having low mass, low density, and moderate resistivity and that are thermally stable at the temperatures experienced during use. Useful heating elements heat and cool rapidly, and thus provide for the efficient use of energy. Rapid heating of the element also provides almost immediate volatilization of the aerosol-forming substance. Rapid cooling prevents substantial volatilization (and hence waste) of the aerosol-forming substance during periods when aerosol formation is not desired. Such heating elements also permit relatively precise control of the temperature range experienced by the aerosol-forming substance, especially when time based current control is employed. Useful heating elements also are chemically non-reactive with the materials comprising the inhalable substance medium being heated so as not to adversely affect the flavor or content of the aerosol or vapor that is produced. Exemplary, non-limiting, materials that may comprise the heating element include carbon, graphite, carbon/graphite composites, metallic and non-metallic carbides, nitrides, silicides, inter-metallic compounds, cermets, metal alloys, and metal foils. In particular, refractory materials may be useful. Various, different materials can be mixed to achieve the desired properties of resistivity, mass, thermal conductivity, and surface properties. As seen in FIG. 4, the electrical heating member is configured as a coil 405 positioned near the terminal end of the projection 225 with contacts 410 connecting the coil to the electrical energy source. Such coil (and optionally the leads) may be formed of any suitable material, such as described above, and preferably exhibits properties, such as described above.

In other embodiments, the heating member 400 can take on other configurations. For example, the heating member may comprise an array of individual heating elements that are individually controlled to heat only the portion of the inhalable substance medium 350 in direct contact with the individual element. Such direct contact can be preferred in light of the ability to provide conduction heating that is more rapid and that requires less resistance. For example, the projection 225 may comprise such an array in a shape that corresponds to the shape of the inhalable substance medium in the cartridge 300. More specifically, when the inhalable substance medium is tubular, the heating member may be a tubular member divided into sections along the length thereof to provide an array of resistive heaters. Alternatively, the tubular member may be divided into sections around the circumference thereof to provide an array of resistive heaters. In each embodiment, the tubular inhalable substance medium can only be heated in the section corresponding to the section of the heater array that is heated (only one section being heatable at any one time). Preferably, such sections of the heater array can be separated by non-heating or insulative sections so as to avoid overlap of heated sections on the inhalable substance medium. In other embodiments, the heater array may be linear, and the inhalable substance medium may be shaped and dimensioned to interact with such linear shape. Examples of such heater arrays that may be adapted for use in the present invention per the discussion provided above can be found in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., which are incorporated herein by reference in their entireties.

In light of the various possible heater configurations, the invention also encompasses embodiments wherein the inhalable substance medium 350 may be coated, laminated, or otherwise attached directly to the heating element(s). In one example, the heating element may be in the form of a metal foil—e.g., stainless steel foil, aluminum foil, copper foil, and the like. For example the foil may have a thickness of about 0.05 mm to about 10 mm, about 0.1 mm to about 8 mm, about 0.2 mm to about 6 mm, about 0.5 mm to about 5 mm, or about 1 mm to about 4 mm. The foil likewise may have a length of about 20 mm to about 150 mm, about 40 mm to about 120 mm, or about 50 mm to about 100 mm. The heating element foil may be provided in any useful configuration, such as a significantly straight line or coiled (e.g., having a coil diameter of about 4 mm to about 15 mm, about 5 mm to about 12 mm, or about 6 mm to about 10 mm) or otherwise provided in a convoluted configuration. In still other embodiments, the heating element may be provided as multiple layers of discs (e.g., diameter of about 1 mm to about 6 mm, about 1.5 mm to about 5 mm, or about 2 mm to about 4 mm) may be arranged in sequence (and optionally activated in sequence) to release aerosol forming materials coated thereon or adjacent thereto. The heating element further may comprise a fibrous material having a high surface area and an adsorbent, porous, wettable characteristic in order to carry a suitable amount of the inhalable substance alone or in combination with a separate aerosol-former. For example, the heating element may be in the form of porous metal wires or films; carbon yarns, cloths, fibers, discs, or strips; graphite cylinders, fabrics, or paints; microporous high temperature polymers having moderate resistivities; porous substrates in intimate contact with resistance heating components; and the like. In preferred designs, it can be useful to maximize heater surface area, which can result in a reduced heater temperature requirement to achieve the proper aerosol release. In a specific example, the inhalable substance medium 350 may comprise a mix of finely ground tobacco, tobacco extract, spray dried tobacco extract, or other tobacco form mixed with optional inorganic materials (such as calcium carbonate), optional flavors, and the aerosol forming materials to form a substantially solid or moldable (e.g., extrudable) substrate. This solid or moldable substrate then may be attached directly to the heating element. As noted above, multiple heater elements with the inhalable substance medium 350 directly attached thereto may be arranged in and activated in sequence to release their aerosol forming materials.

In particular embodiments, the heating member can be integral with (e.g., embedded within) the inhalable substance medium. For example, the inhalable substance medium 350 may be formed of a material as described above and may include one or more conductive materials mixed therein. Contacts 410, as described herein, may be connected directly to the inhalable substance medium such that, when the cartridge 300 is inserted into the receiving chamber 210 of the control housing 200, the contacts make electrical connection with the electrical energy source 220. Alternatively, the contacts may be integral with the electrical energy source and extend into the receiving chamber such that, when the cartridge is inserted into the receiving chamber of the control housing, the contacts make electrical connection with the inhalable substance medium. Because of the presence of the conductive material in the inhalable substance medium, the application of power from the electrical energy source to the inhalable substance medium allows electrical current to flow and thus produce heat from the conductive material. Thus, the heating member may be described as being integral with the inhalable substance medium. As a non-limiting example, graphite or other suitable, conductive material may be mixed with, embedded in, or otherwise present directly on or within the material forming the inhalable substance medium to make the heating member integral with the medium.

In even further embodiments, a conventional heating member according to the various constructions described herein also may be combined with the inhalable substance medium so to be at least partially embedded therein. For example, referring to FIG. 12, the heating coil 407 may be integrally formed with the inhalable substance medium 350 so that at least a portion of the heating coil is fully located within the outer and inner walls of the inhalable substance medium. In such embodiments, the electrical contacts 410 may extend out of the inhalable substance medium. In even further embodiments, a vapor barrier that is present on the inhalable substance medium may function as the heating member also.

The control housing 200 further can include additional components that preferably are present in the control segment 205 (although one or more of such additional components may be located completely or partially within the receiving chamber 210 or be in communication with the receiving chamber). For example, the control housing preferably includes a control circuit 260 (which may be connected to further components, as further described herein) that is connected by electrically conductive wires (not shown) to a power source 275. The control circuit particularly can control when and how the heating member 400 receives electrical energy to heat the inhalable substance medium 350 for release of the inhalable substance for inhalation by a consumer. Such control can relate to actuation of pressure sensitive switches or the like, which are described in greater detail hereinafter.

The control components particularly can be configured to closely control the amount of heat provided to the inhalable substance medium 350. While the heat needed to volatilize the aerosol-forming substance in a sufficient volume to provide a desired dosing of the inhalable substance for a single puff can vary for each particular substance used, it can be particularly useful for the heating member to heat to a temperature of at least 120° C., at least 130° C., or at least 140° C. In some embodiments, in order to volatilize an appropriate amount of the aerosol-forming substance and thus provide a desired dosing of the inhalable substance, the heating temperature may be at least 150° C., at least 200° C., at least 300° C., or at least 350° C. It can be particularly desirable, however, to avoid heating to temperatures substantially in excess of about 550° C. in order to avoid degradation and/or excessive, premature volatilization of the aerosol-forming substance. Heating specifically should be at a sufficiently low temperature and sufficiently short time so as to avoid significant combustion (preferably any combustion) of the inhalable substance medium. The present invention particularly can provide the components of the present article in combinations and modes of use that will yield the inhalable substance in desired amounts at relatively low temperatures. As such, yielding can refer to one or both of generation of the aerosol within the article and delivery out of the article to a consumer. In specific embodiments, the heating temperature can be about 120° C. to about 300° C., about 130° C. to about 290° C., about 140° C. to about 280° C., about 150° C. to about 250° C., or about 160° C. to about 200° C. The duration of heating can be controlled by a number of factors, as discussed in greater detail hereinbelow. Heating temperature and duration may depend upon the desired volume of aerosol and ambient air that is desired to be drawn through the annular space 319 defined by the inner surface of the wall of the cartridge body 305 and the outer surface of the wall 352 of the inhalable substance medium 350, as further described herein. The duration, however, may be varied depending upon the heating rate of the heating member, as the article may be configured such that the heating member is energized only until a desired temperature is reached. Alternatively, duration of heating may be coupled to the duration of a puff on the article by a consumer. Generally, the temperature and time of heating will be controlled by one or more components contained in the control housing, as noted above.

The amount of inhalable material released by the inventive article 10 can vary based upon the nature of the inhalable material. Preferably, the article 10 is configured with a sufficient amount of the inhalable material, with a sufficient amount of any aerosol-former, and to function at a sufficient temperature for a sufficient time to release a desired amount over a course of use. The amount may be provided in a single inhalation from the article 10 or may be divided so as to be provided through a number of puffs from the article over a relatively short length of time (e.g., less than 30 minutes, less than 20 minutes, less than 15 minutes, less than 10 minutes, or less than 5 minutes). For example, the article may provide nicotine in an amount of about 0.05 mg to about 1.0 mg, about 0.08 mg to about 0.5 mg, about 0.1 mg to about 0.3 mg, or about 0.15 mg to about 0.25 mg per puff on the article 10. In other embodiments, a desired amount may be characterized in relation to the amount of wet total particulate matter delivered based on puff duration and volume. For example, the article 10 may deliver at least 1.0 mg of wet total particulate matter on each puff, for a defined number of puffs (as otherwise described herein), when smoked under standard FTC smoking conditions of 2 second, 35 ml puffs. Such testing may be carried out using any standard smoking machine. In other embodiments, the amount of wet total particulate matter (WTPM) delivered under the same conditions on each puff may be at least 1.5 mg, at least 1.7 mg, at least 2.0 mg, at least 2.5 mg, at least 3.0 mg, about 1.0 mg to about 5.0 mg, about 1.5 mg to about 4.0 mg, about 2.0 mg to about 4.0 mg, or about 2.0 mg to about 3.0 mg. The same values may be applied when characterizing the article in terms of the amount of vapor or aerosol that is yielded per puff.

Returning to FIG. 4, a particular embodiment of the inventive article 10 is illustrated wherein the article is indexable to provide segmented heating of the inhalable substance medium 350. In use, according to this embodiment, the engaging end 310 (including any overwrap that is present and extending beyond the end of the cartridge wall 305) of a cartridge 300 is inserted into the receiving chamber 210 of the control housing 200. As seen more clearly in FIG. 7, when the engaging end of the cartridge slides a minimum, operably distance into the receiving chamber, the inhalable substance medium 350, the electrical heating member 400, and the electrical energy source 220 align so as to allow for heating of at least a segment of the inhalable substance medium 350.

Such alignment can result from the direct cross-sectional alignment of the three components (e.g., the inhalable substance medium 350, the electrical heating member 400, and the projection 225 functioning as an extension of the electrical energy source 220 are all aligned such that a cross-section of the area of alignment can encompass a portion of all three components). Alternatively, only the inhalable substance medium 350 and the electrical heating member 400 may be in a direct cross-sectional alignment, but the electrical energy source 220 may be considered aligned therewith in that the electrical heating member is aligned with the electrical energy source 220 so as to make an electrical connection therewith. This may be referred to as an operable alignment.

Figure 7:
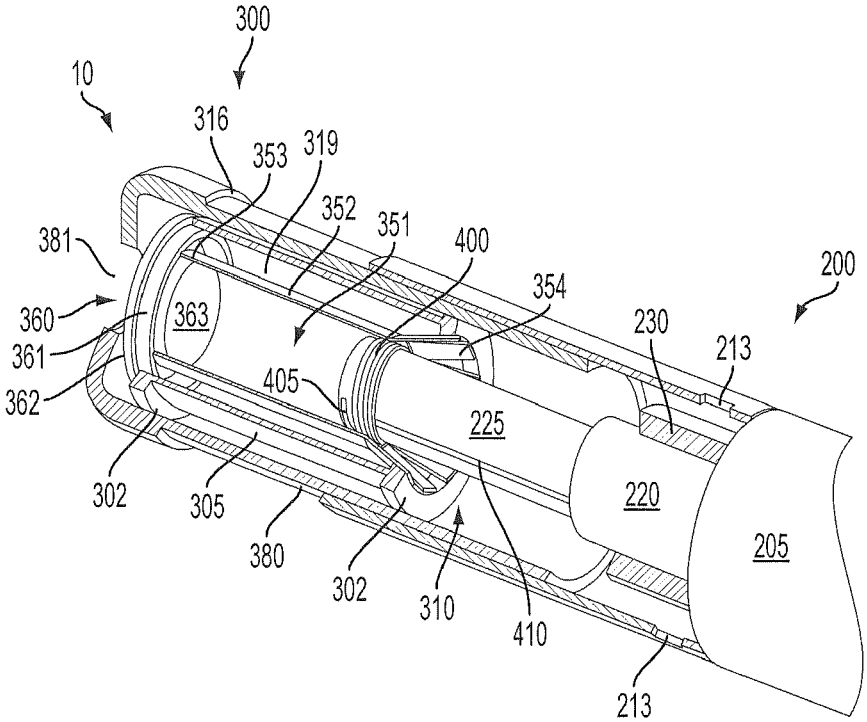
FIG. 7 is a perspective view of the article from FIG. 4, wherein the cartridge is inserted a minimum distance into the receiving chamber of the control housing, said minimum distance being a distance such that the heating member on the projection is positioned within the central cavity of the tubular inhalable substance medium and in sufficient contact therewith to heat at least a portion of the inhalable substance medium.

The embodiment illustrated in FIG. 4 and FIG. 7 provides for segmented heating of the inhalable substrate medium 350, the segmented heating proceeding axially from the second end 354 of the inhalable substrate medium to the first end 353 of the inhalable substrate medium. As seen in FIG. 7, the cartridge 300 has been inserted into the receiving chamber 210 of the control housing 200 the minimum distance necessary such that the heating member 400 that is attached to the projection 225 and in electrical connection with the electrical energy source 220 has been positioned inside the central cavity 351 of the tubular inhalable substance medium. In this embodiment, the second end 354 of the inhalable substance medium has been segmented, the segmented end being the point of attachment to the engaging end 310 of the cartridge body 305. The segmented nature of the second end of the inhalable substance medium can be such that one or more openings are provided in the engaging end 310 of the cartridge to facilitate air entry into the annular space 319. In particular embodiments, the segmented end also can be flared, which can allow for the tubular body of the inhalable substance medium to have a diameter that is less than the diameter of the segmented end of the inhalable substance medium. Such segmented and (optionally) flared arrangement facilitates one or more of the following: tensioning of the inhalable substance medium within the cartridge body; configuration of the tubular inhalable substance medium to have a diameter that is less than the diameter of the tubular cartridge body; and provision for passage of air through the annular space defined by the outer surface of the wall 352 of the inhalable substance medium and the inner surface of the wall of the cartridge body. Thus, the cartridge can be characterized as including a flow path therethrough such that fluid passage from the engaging end of the cartridge to the mouth end 315 of the cartridge is substantially limited to passage through the annular space 319 between the inner surface of the cartridge body wall and the outer surface of the inhalable substance medium wall.

In further embodiments, other means can be provided to allow air flow into the annular space. For example, the inhalable substance medium may be attached to a ferrule that is directly attached to the cartridge body. In such embodiments, the ferrule and/or a portion of the inhalable substance medium near the ferrule may be perforated. Alternatively, the cartridge (and optionally the overwrap, when present) may include apertures or perforation that allow air flow directly into the annular space.

The configuration of the cartridge body 305 and the cartridge overwrap 380 preferably is such that air passage around the cartridge body and between the cartridge body and the overwrap is significantly prevented. Thus, as seen in FIG. 7, the flange 302 at the engaging end 310 of the cartridge body is sized such that outer rim of the flange is in direct contact with the cartridge overwrap around the entire circumference thereof.

The receiving chamber wall 212 can include one or more apertures 213 therein for allowing entrance of ambient air into the interior of the receiving chamber 210. When a consumer draws on the mouth end of the cartridge 300, air thus can be drawn into the receiving chamber, pass into the cartridge, be drawn through the segmented and flared second end 354 of the inhalable substance medium 350, enter the annular space 319 between the inhalable substance medium and the cartridge body 305, and pass through the open space in the cartridge frame member 360 for inhalation by the consumer. In embodiments wherein the overwrap 380 is present, the drawn air carries the inhalable substance through the optional filter 390 (illustrated in FIG. 6) and out of the opening 381 at the mouth end of the overwrap.

The wider opening of the cartridge body 305 at the engaging end 310 thereof (along with the segmented and flared nature of the second end 354 of the inhalable substance medium 350) facilitates ease of directing the projection 225 (with the heating member 400 thereon) into the interior space of the tubular inhalable substance medium 350. With the heating member positioned inside the beginning section of the tubular portion of the inhalable substance medium, the heating member can be activated to heat the inhalable substance medium and cause release of the inhalable substance into the annular space between the inhalable substance medium and the cartridge body. Alternatively, in some embodiments, activation of the heating member may volatilize the aerosol forming material and/or the inhalable substance of the inhalable substance medium such that, when ambient air is drawn through the annular space, the volatilized material(s) become aerosolized and entrained in the air flowing through the annular space and to the mouth end for inhalation by the consumer.

In embodiments wherein segmented heating is provided with a heating member 400 that is physically a component of the control housing 200, the heating member typically will be present on the projection 225 only a long a segment of defined length. As shown in FIG. 4 and FIG. 7, the segment wherein the heating member is located can be in proximity to the end of the projection at the open end of the receiving chamber 210. The relative percentage of the projection that includes the heating member can be based on the total length of the inhalable substance medium 350 and the number of puffs to be delivered by a single cartridge 300. Preferably, a single cartridge can provide about 4 to about 12, about 5 to about 11, or about 6 to about 10 puffs, which approximates the number of puffs in a typical cigarette. Thus, for segmented heating, the segment of the projection that includes the heating member can encompass about 5% to about 50% of the overall length of the projection. In other embodiments, the segment can encompass about 5% to about 40%, about 5% to about 30%, about 5% to about 20%, or about 10% to about 20% of the overall length of the projection.

As noted above, a vapor barrier 375 (as illustrated in FIG. 4*a*) may be present on the inner surface of the wall 352 of the inhalable substance medium 350 to reduce or prevent aerosol or vapor formation within the interior space of the tubular inhalable substance medium and maximize aerosol or vapor formation within the noted annular space. Further, the presence of the heating member 400 within the interior space of the tubular inhalable substance medium can reduce vapor losses that may result from interaction of the vapor and the heating member. Still further, such positioning can function to separate the heating member from the airstream flowing within the article during draw (as described above). This can be beneficial to maximize heat delivery from the heating member to the inhalable substance medium and thus allow for lower heating temperatures and/or shorter heating duration while still achieving the desired aerosol formation and release of the inhalable substance. This configuration likewise can provide for lower energy consumption necessary to achieve the necessary heating temperature, and this in turn can facilitate increased battery life (or can lessen the energy content that must be stored in a capacitor for complete use of a cartridge).

The content of aerosol or vapor and the inhalable substance that is released during heating can be based on a variety of factors. In some embodiments, it can be useful for the annular space 319 between the inhalable substance medium 350 and the cartridge body 305 (or the outer body in embodiments wherein the cartridge and the overwrap are combined) to be of a defined volume. For example, the annular space can have a volume of at least 0.25 ml, at least 0.5 ml, at least 0.75 ml, at least 1.0 ml, or at least 1.25 ml. In other embodiments, the volume of the annular space can be about 0.25 ml to about 5.0 ml, about 0.5 ml to about 3.0 ml, about 0.7 ml to about 2.0 ml, or about 0.7 ml to about 1.5 ml. In various embodiments, the total volume of aerosol that is generated in a single puff may be greater than the annular space volume since aerosol being formed is continuously swept away with air that is pulled through the annular space to combine with the aerosol for passage to the consumer as the total puff volume. For example, in an average puff time of about 2 seconds, a puff volume of about 25 ml to about 75 ml, about 30 ml to about 70 ml, about 35 ml to about 65 ml, or about 40 ml to about 60 ml may be delivered to the consumer. Such total puff volume may provide, in certain embodiments, the WTPM content previously described. Thus, WTPM as delivered may be characterized in relation to the total puff volume—e.g., about 1 mg to about 4 mg WTPM in a total puff volume of about 25 ml to about 75 ml. Such characterization is inclusive of all puff volume values and WTPM values otherwise described herein.

From the above, it is evident that the annular space can be defined in relation to providing both an actual head space and a dynamic head space. The annular space provides an actual head space in that the annular space has a quantifiable volume based upon the length of the inhalable substance medium, the relative diameters of the inhalable substance medium and the cartridge, and the actual shape of each component. By contrast, the annular space can be defined as a dynamic head space in that the inventive article is not limited to aerosol production of a volume only sufficient to fill the actual annular space volume during a single puff Rather, during a single puff, aerosol may be formed continuously, and the formed aerosol is continuously drawn out of the annular space during the puff. Thus, the annular space provides a dynamic head space that can be quantified in terms of the total puff volume that is drawn through the annular space during a single puff. The dynamic head space may vary between puffs depending upon draw strength and puff length. The dynamic head space, in certain embodiments, may have a volume as described above over an average puff time of about 2 seconds.

In some embodiments, it may be useful to provide some indication of when the cartridge 300 has achieved the minimum distance of insertion into the receiving chamber 210 such that the heating member 400 on the projection 225 is positioned precisely into the initial, heatable section or segment of the tubular inhalable substance medium 350. For example, the cartridge may include one or more markings (or a graduated scale) on the exterior thereof (e.g., on the outer surface of the cartridge overwrap 380). A single mark may indicate the depth of insertion required to achieve this initial position for use (e.g., as illustrated in FIG. 7). Further marks may indicate the distance the cartridge must be indexed into the receiving chamber to position the heating member on a fresh section of the inhalable substance medium that has not previously been heated for release of the inhalable substance. Alternatively, the cartridge and the receiving chamber may include one or a series of grooves (or detents) and projections (interchangeable between the two components) that provide a tactile indication of when the initial heating position has been reached and when the cartridge has been indexed a further distance necessary to position the heating member on a fresh section of the inhalable substance medium that has not previously been heated for release of the inhalable substance. Any such means that can enable a consumer to recognize and understand that the cartridge has been indexed sufficiently in the receiving chamber to position the heating member on a fresh section of the inhalable substance medium may be used in the present article 10.

Figure 8:
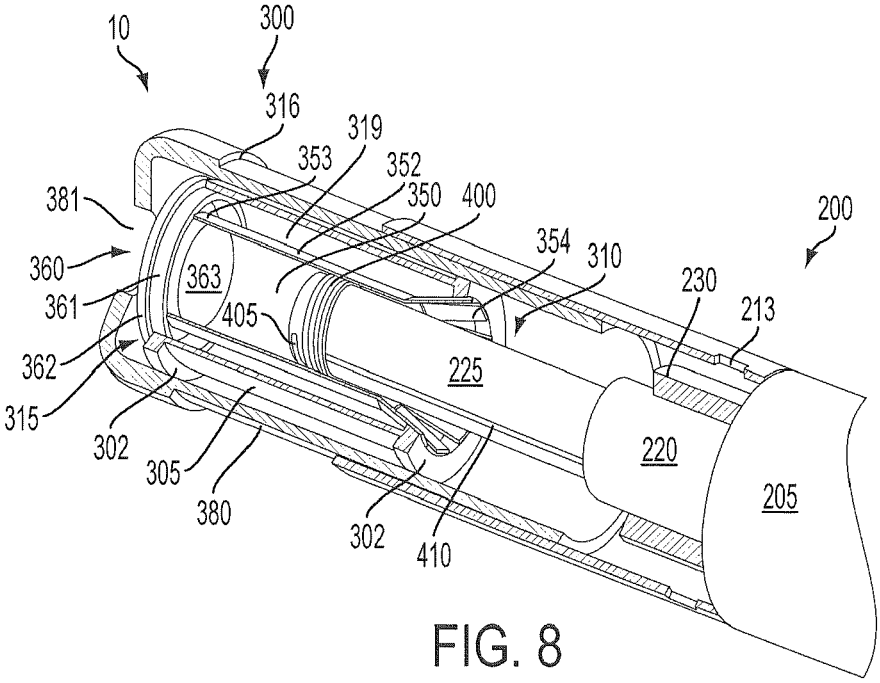
FIG. 8 is a perspective view of the article from FIG. 7, wherein the cartridge is indexed into the receiving chamber of the control housing such that the heating member on the projection is positioned further into the central cavity of the tubular inhalable substance medium so as to have moved a distance away from the engaging end of the cartridge and the same distance toward the mouth end of the cartridge.

FIG. 8 further illustrates the segmented heating of the present embodiment. After the heating member 400 has been activated in relation to FIG. 7 and the inhalable substance on the heated section of the inhalable substance medium 350 has been released for inhalation by the consumer, the cartridge 300 is then further indexed into the receiving chamber 210 such that the cartridge indexes past the segment of the projection 225 having the electrical heating member present thereon. FIG. 8 shows the article 10 after said indexing has occurred. The heating member now is positioned within the tubular inhalable substance medium closer to the mouth end of the cartridge body 305 and beyond the segment of the inhalable substance medium that was previously heated. Thus, the heating member now is positioned near a fresh section of the inhalable substance medium. This indexing of the cartridge within the receiving chamber for heating individual segments of the inhalable substance medium can be achieved via a variety of mechanisms, any of which can be encompassed by the present invention. For example, the indexing may be manually controlled by the consumer such that, after a puff, the cartridge may be manually pushed further into the receiving chamber by the consumer tapping on the mouth end of the cartridge or otherwise applying force manually to push the cartridge further into the receiving chamber. The consumer may determine the appropriate distance the cartridge needs to be pushed into the receiving chamber via the graduated markings on the cartridge, as described, or by the tactile sensation of the cartridge passing through another notch within the receiving chamber, both of which are already described above.

In other embodiments, the article 10 may include further components useful to facilitate indexing of the cartridge 300 within the receiving chamber 210. For example, the article may include a pushbutton 15 that may actuate indexing of the cartridge into the receiving chamber 210 by mechanical means (not shown). In such embodiments, the control housing 200 may include an engaging member that removably attaches to the cartridge, and actuation of the pushbutton may function to move a pawl that allows a spring attached to the engaging member to move the cartridge one position further into the receiving chamber and thus move the inhalable substance medium 350 relative to the heating member 400 such that the heating member is in position to heat a fresh section of the inhalable substance medium. In specific embodiments, the pushbutton may be linked to the control circuit 260 for manual control of the heating member and, optionally, the actuation of the cartridge. For example, the consumer may use the pushbutton to energize the heating member. Optionally, the pushbutton still may be mechanically linked to the cartridge, such as in the example described above, so that actuation of the pushbutton moves the cartridge one segment forward and then energizes the heating member to heat the fresh segment of the inhalable substance medium. Alternatively, actuation of the pushbutton may first energize the heating member (already positioned at a fresh section of the inhalable substance medium) and then, upon release of the button (or after a defined delay), the mechanical elements may engage to move the cartridge one segment forward so that the heating member is already positioned at a fresh segment of the inhalable substance medium for when the pushbutton is actuated again to energize the heating member. Similar functionality tied to the pushbutton may be achieved by other mechanical means or non-mechanical means (e.g., magnetic or electromagnetic). Similar functionality also may be achieved automatically via an internal switch activated by either pressure or airflow provided by the consumer during a puff Thusly, activation of the heating member and indexing of the cartridge can be controlled by a single pushbutton. Alternatively, multiple pushbuttons may be provided to control each action separately. One or more pushbuttons present may be substantially flush with the casing of the control housing.

Instead of (or in addition to) the pushbutton 15, the inventive article 10 can include components that energize the heating member 400 in response to the consumer's drawing on the article (i.e., puff-actuated heating). For example, the article may include a switch 280 in the control segment 205 of the control housing 200 that is sensitive either to pressure changes or air flow changes as the consumer draws on the article (i.e., a puff-actuated switch). Other suitable current actuation/deactuation mechanisms may include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. With such sensor, the heating member is activated rapidly by a change in pressure when the consumer draws on the article. In addition, flow sensing devices, such as those using hot-wire anemometry principles, may be used to cause the energizing of the heater member 400 sufficiently rapidly after sensing a change in air flow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a heating circuit according to the present invention are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and the receiving chamber 210 preferably is included in the control housing 200 so that pressure changes during draw are readily identified by the switch.

When the consumer draws on the mouth end of the article 10, the current actuation means can permit unrestricted or uninterrupted flow of current through the resistance heating member 400 to generate heat rapidly. Because of the rapid heating, it can be useful to include current regulating components to (i) regulate current flow through the heating member to control heating of the resistance element and the temperature experienced thereby, and (ii) prevent overheating and degradation of the inhalable substance medium 350.

The current regulating circuit particularly may be time based. Specifically, such a circuit includes a means for permitting uninterrupted current flow through the heating element for an initial time period during draw, and a timer means for subsequently regulating current flow until draw is completed. For example, the subsequent regulation can include the rapid on-off switching of current flow (e.g., on the order of about every 1 to 50 milliseconds) to maintain the heating element within the desired temperature range. Further, regulation may comprise simply allowing uninterrupted current flow until the desired temperature is achieved then turning off the current flow completely. The heating member may be reactivated by the consumer initiating another puff on the article (or manually actuating the pushbutton, depending upon the specific switch embodiment employed for activating the heater). Alternatively, the subsequent regulation can involve the modulation of current flow through the heating element to maintain the heating element within a desired temperature range. In some embodiments, so as to release the desired dosing of the inhalable substance, the heating member may be energized for a duration of about 0.2 second to about 5.0 seconds, about 0.3 second to about 4.0 seconds, about 0.4 second to about 3.0 seconds, about 0.5 second to about 2.0 seconds, or about 0.6 second to about 1.5 seconds. One exemplary time-based current regulating circuit can include a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits is provided in U.S. Pat. No. 4,947,874 to Brooks et al., which is incorporated herein by reference in its entirety.

In light of the foregoing, it can be seen that a variety of mechanisms can be employed to facilitate actuation/deactuation of current to the heating member 400. For example, the inventive article 10 can comprise a timer for regulating current flow in the article (such as during draw by a consumer). The article further can comprise a timer responsive switch that enables and disables current flow to the heating member. Current flow regulation also can comprise use of a capacitor and components for charging and discharging the capacitor at a defined rate (e.g., a rate that approximates a rate at which the heating member heats and cools). Current flow specifically may be regulated such that there is uninterrupted current flow through the heating member for an initial time period during draw, but the current flow may be turned off or cycled alternately off and on after the initial time period until draw is completed. Such cycling may be controlled by a timer, as discussed above, which can generate a preset switching cycle. In specific embodiments, the timer may generate a periodic digital wave form. The flow during the initial time period further may be regulated by use of a comparator that compares a first voltage at a first input to a threshold voltage at a threshold input and generates an output signal when the first voltage is equal to the threshold voltage, which enables the timer. Such embodiments further can include components for generating the threshold voltage at the threshold input and components for generating the threshold voltage at the first input upon passage of the initial time period.

In further embodiments wherein segmented heating is provided, puff actuation of the heating member 400 may be coupled to movement of the cartridge 300 through the receiving chamber 210. For example, the current regulating component may allow the heating member to rapidly achieve the desired temperature and then remain at that temperature for the duration of the puff by the consumer. Further, puff actuated movement of the cartridge through the receiving chamber may be continuous for the duration of the puff. Once the puff ceases, the heating member will be deactivated, and the cartridge will cease movement within the receiving chamber. Thus, the distance traveled by the cartridge during automatic indexing can be directly related to the duration of a puff. In this manner, the consumer may have control over the amount of the inhalable substance that is delivered by a single puff. A short puff can only deliver a small amount of the inhalable substance. A longer puff can deliver a greater amount of the inhalable substance. Thus, a large, initial puff may provide a bolus of the inhalable substance, and shorter puffs thereafter may provide smaller amounts of the inhalable substance. Exemplary puff actuation devices that may be useful according to the invention are disclosed in U.S. Pat. Nos. 4,922,901, 4,947,874, and 4,947,874, all to Brooks et al., all of which are incorporated herein by reference in their entireties.

The power source 275 used to provide power to the various electrical components of the inventive article 10 can take on various embodiments. Preferably, the power source is able to deliver sufficient energy to rapidly heat the heating member 400 in the manner described above and power the article through use with multiple cartridges 300 while still fitting conveniently in the article. One example of a useful power source is a N50-AAA CADNICA nickel-cadmium cell produced by Sanyo Electric Company, Ltd., of Japan. A plurality of such batteries, providing 1.2-volts each, may be connected in series. Other power sources, such as rechargeable lithium-manganese dioxide batteries, can be used. Any of these batteries or combinations thereof can be used in the power source, but rechargeable batteries are preferred because of cost and disposal considerations associated with disposable batteries. In addition, if disposable batteries are used, the control segment 205 must be openable for replacement of the battery. In embodiments where rechargeable batteries are used, the control segment further can comprise charging contacts 217, as shown in FIG. 1, for interaction with corresponding contacts in a conventional recharging unit (not shown) deriving power from a standard 120-volt AC wall outlet, or other sources such as an automobile electrical system or a separate portable power supply.

In further embodiments, the power source 275 also may comprise a capacitor. Capacitors are capable of discharging more quickly than batteries and can be charged between puffs, allowing the battery to discharge into the capacitor at a lower rate than if it were used to power the heating member 400 directly. For example, a supercapacitor—i.e., an electric double-layer capacitor (EDLC)—may be used separate from or in combination with a battery. When used alone, the supercapacitor may be recharged before each use of the article 10. Thus, the invention also may include a charger component that can be attached to the device between uses to replenish the supercapacitor. Thin film batteries may be used in certain embodiments of the invention.

The article 10 also may comprise one or more indicators 219 (as illustrated in FIG. 1). Such indicators 219 may be lights (e.g., light emitting diodes) that can provide indication of multiple aspects of use of the inventive article. For example, a series of lights as shown in FIG. 1 may correspond to the number of puffs for a given cartridge. Specifically, the lights may become lit with each puff indicating to a consumer that the cartridge 300 was completely used when all lights were lit. Alternatively, all lights may be lit upon the cartridge engaging the receiving chamber 210, and a light may turn off with each puff indicating to a consumer that the cartridge was completely used when all lights were off. In still other embodiments, only a single indicator may be present, and lighting thereof may indicate that current was flowing to the heating member 400 and the article 10 was actively heating. This may ensure that a consumer did not unknowingly leave an article unattended in an actively heating mode. In alternative embodiments, one or more of the indicators may be a component of the cartridge. Although the indicators are described above in relation to visual indicators in an on/off method, other indices of operation also are encompassed. For example, visual indicators also may include changes in light color or intensity to show progression of the smoking experience. Tactile indicators and sound indicators similarly are encompassed by the invention. Moreover, combinations of such indicators also may be used in a single article.

Although a variety of materials for use in the present device, such as heaters, batteries, capacitors, switching components, and the like have been described, the invention should not be construed as being limited to only the exemplified embodiments. Rather, one of skill in the art can recognize based on the present disclosure similar components in the field that may be interchanged with any specific component of the present invention. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

Figure 8A:
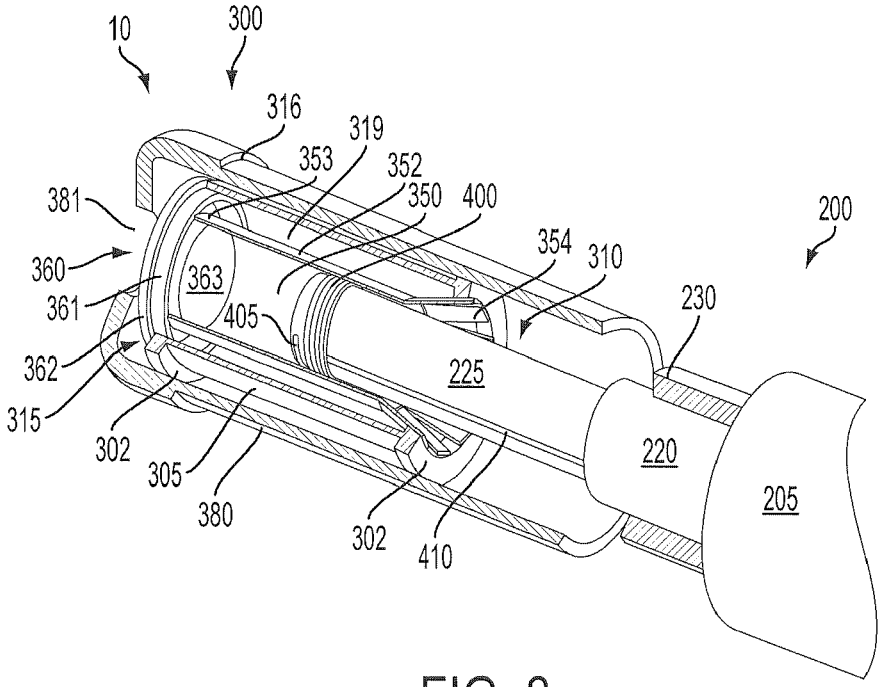
FIG. 8*a* is a perspective view of a portion of an article according an embodiment of the invention showing a cartridge engaging the receiving end of a control housing (which is only partially shown), the control housing including a projection with a heating member thereon to provide for segmented heating of the inhalable substance medium in the cartridge, the cartridge being partially cut away to reveal the underlying components of the article.
Figure 8B:
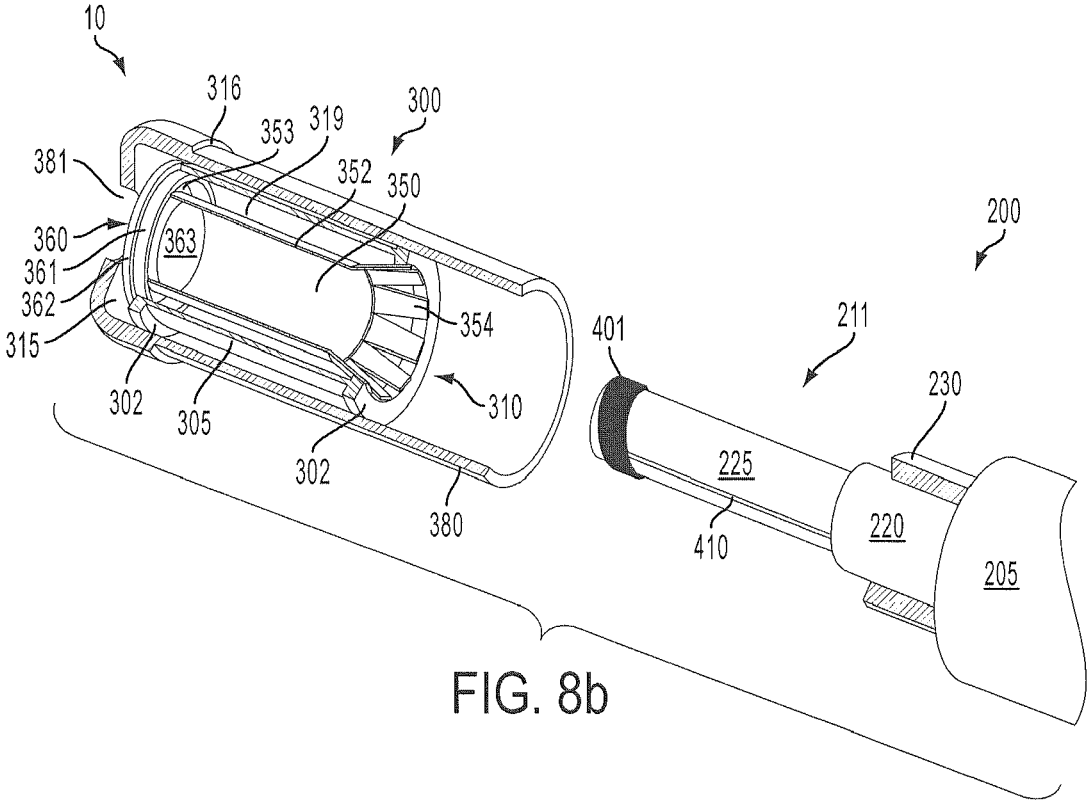
FIG. 8*b* is a perspective view of a portion of an article according an embodiment of the invention showing a cartridge disengaged from the receiving end of a control housing (which is only partially shown and which does not include walls defining a chamber), the control housing including a heating member located on a projection and surrounded by a heat spreading member to provide for segmented heating of the inhalable substance medium in the cartridge, the cartridge being partially cut away to reveal the underlying components of the article.

Although the inventive article has been discussed in relation to certain embodiments, the invention also encompasses a variety of further embodiments. For example, FIG. 8*a* illustrates the embodiment from FIG. 8 but wherein the control housing 200 does not include a receiving chamber. Rather, the control housing can be described as comprising a receiving end 211 (as shown in FIG. 8*b*). Such receiving end can include all of the components otherwise described herein in relation to embodiments including the receiving chamber. The chamber wall is absent, however, such that the further components (e.g., the projection 225) define the receiving end and extend from the control segment portion of the control housing.

While the foregoing has particularly described segmented heating wherein the electrical heating member 400 is attached to the projection 225 or is otherwise provided as a component part of the control housing 200, FIG. 9 illustrates another embodiment of segmented heating wherein the electrical heating member is a component part of the cartridge 300. In such embodiments, the heating member (which in this embodiment is a heating coil 406) particularly can be present in the interior space of the tubular inhalable substance medium 350, and the heating member may be maintained therein by frictional forces, and/or outwardly directed pressure exerted on the inhalable substance medium by the heating coil (e.g., wherein the heating coil exhibits springing action and is compressed to some extent prior to insertion), and/or by being at least partially embedded within the inhalable substance medium.

Use of the article 10 in such embodiments can be substantially identical to the use as described above. In particular, a consumer can insert the cartridge 300 into the receiving chamber 210 of the control housing 200 (or slide the cartridge over the projection 225 when the chamber walls are absent). The components of the cartridge can be positioned within the cartridge to align with and receive the projection 225 as the cartridge slides into the receiving chamber. The minimum distance required to align all components for heating of the inhalable substance medium 350 can be the distance required for the electrical leads 222 present on the projection to make an electrical connection with the heating coil 406 (or for an alternative electrical connection to be operatively engaged). Segmented heating is provided in that electrical current can only flow in the portion of the heating coil between the electrical leads. Indexing of the cartridge can proceed as described above after the first segment of the inhalable substance medium 350 had been heated so that the electrical leads may make contact with the heating coil in the next segment of the cartridge. Puff-actuated heating followed by indexing may continue until the entire inhalable substance medium had been used (i.e., the inhalable substance and the aerosol-forming material released from the inhalable substance medium).

Generally, segmented heating embodiments of the invention can arise from any combination of the heating element and the inhalable substance medium in a manner wherein only a portion of the inhalable substance medium is heated at a single time. Thusly, for each puff on the device, an essentially fresh section of the inhalable substance medium is in alignment with the heating element for heating. Accordingly, the invention encompasses any variation of the segmented heating embodiments described herein wherein one or both of the inhalable substance medium and the heating member (which may extend to the cartridge and the control housing as well) are manipulated such that only a portion of the inhalable substance medium is heated at any given time and the manipulation positions the heating member of a fresh portion of the inhalable substance medium for each subsequent puff. For example, twisting of one of the control housing or the cartridge (with the other not moving) may be effective to place the heater on a fresh area of inhalable substance medium (with optional inward or outward movement of the cartridge within the receiving chamber control housing). In such embodiments, the heating member may comprise a lateral heating element (or series of elements) that may be substantially the same length as the inhalable substance medium.

As seen in FIG. 9, it can be preferable for the electrical leads 222 to be present on the projection 225 in proximity to the end of the projection 225 at the open end of the receiving chamber 210. Thus, in connection with the description above, the electrical leads 222 form an electrical connection with discrete segments of the electrical heating coil 406 such that when heating occurs, only the portion of the inhalable substance medium 350 in proximity to the segment of the electrical heating coil 406 in electrical connection with the projection 225 is heated. In certain embodiments, the segment of the electrical heating coil 406 that is in electrical connection with the electrical leads 222 of the projection 225 encompasses about 5% to about 50% of the length of the inhalable subject medium 350. In other embodiments, the segment of the electrical heating coil 406 that is in electrical connection with the electrical leads 222 of the projection 225 encompasses about 5% to about 40%, about 5% to about 30%, about 5% to about 20%, or about 10% to about 20% of the length of the inhalable subject medium 350.

As seen in relation to the foregoing description, the invention encompasses articles 10 wherein segmented heating of the inhalable substance medium 350 is provided. Particularly, the heating member 400 can be reusable, can be provided as a component of the control housing 200, and can be provided on only a segment of the projection 225. Thus, only a segment of the inhalable substance medium 350 is in contact with the heating member 400 at any single time during use. Moreover, no portion of the inhalable substance medium 350 is in physical contact with or in proximity to with the heating member 400 until the cartridge 300 is inserted into the receiving chamber 210 of the controller 200 for use by the consumer. In other embodiments, the heating member 400 can be disposable and be provided as a component of the cartridge 300. In both embodiments, the heating member 400 requires only a single set of contacts 410 or electrical leads 222 for connection to the electrical energy source 220 (e.g., for direct insertion into a receptacle in the electrical energy source 220, or formed on the projection 225 of the electrical energy source 220).

When segmented heating is used, the inhalable substance medium 350 can be modified as desired to control various aspects of release, amount, and flavor. For example, the inhalable substance may be evenly dispersed on or within the inhalable substance medium 350 so that each respective segment that is heated will release substantially the same content of the inhalable substance. Alternatively, the initial area of the inhalable substance medium 350 (i.e., at the second end thereof) that contacts the heating member 400 may be supercharged with the inhalable substance. For example, a single segment of the inhalable substance medium 350 corresponding to the size of the area heated by the heating member 400 may comprise about 30% to about 90%, about 35% to about 75%, or about 40% to about 60% of the total amount of the inhalable substance present in the inhalable substance medium 350. Similarly, a single segment, such as the final segment of the inhalable substance medium 350 heated by the heating member 400, may include a flavor or other material that is different from the remaining portion of the inhalable substance medium 350. Such final release of flavor or other material may function as a signal to a consumer that the cartridge 300 has been completely used. Thus, it can be seen that segmented heating can provide for consistent dosing of the inhalable substance in each heated segment, can provide for clear indication of progress, and can allow for greater control of the device by the consumer.

In various embodiments, the article can be characterized in relation to the total area of the inhalable substance medium that is heated or maximally heated at a given time. For example, in segmented heating embodiments, only a specific segment of the inhalable substance medium is heated or maximally heated at a given time (e.g., about one-sixth to about one-tenth of the area of the inhalable substance medium, or other fraction as necessary to provide the desired number of puffs from a single inhalable substance medium). In some embodiments, it may be useful to provide an electrically resistive heating member, as otherwise described herein, that encompasses only a small heating area—e.g., on a single coil or strip). Thus, it also may be useful according to the invention to include a heat spreading member 401 (as shown in FIG. 8*b*). The inclusion of such member positioned between the heating member and the inhalable substance medium can allow for the use of a relatively small heating member to heat a larger area of the inhalable substance medium. For example, the heating member underlying the heat spreading member may have a width as small as 0.5% to 5% of the total length of the projection 225. The heat spreading member, however, may have a width that is about 10% to about 30%, about 10% to about 20%, or about 10% to about 15% of the total length of the projection. In bulk heating embodiments, the heat spreading member can have a width that is about 75% to about 125%, about 85% to about 110%, or about 90% to about 100% of the length of the inhalable substance medium.

In still other embodiments, the vapor barrier 375 may essentially function as a heating spreading member. For example, the heating member 400 may be relatively small, as discussed above, and may be inserted into the interior space of the inhalable substance medium 350. In contact with the vapor barrier, heat from the heating member may pass to the vapor barrier, which in turn may spread the heat a defined distance upstream and downstream of the actual position of the heating member. Typically, the heat spreading in such manner may not be constant along the length of the vapor barrier. Rather, the heat can be greatest in the area directly adjacent the heating member, and the temperature of the vapor barrier can decrease moving away from the position of the heating member. Heat spreading in this manner may be controlled, for instance, by varying the thickness of the vapor barrier and/or the heat conduction capacity of the vapor barrier. Likewise, the vapor barrier may be formed with heat insulating materials formed therein such that heat spreading can continue upstream and downstream only until the heat insulating material was reached. The area of the vapor barrier between respective heat insulating sections can correspond to the segments of the inhalable substance medium that can be individually heated in segmented heating embodiments.

In further embodiments, heating can be characterized in relation to the amount of aerosol to be generated. Specifically, the article can be configured to provide an amount of heat necessary to generate a defined volume of aerosol (e.g., about 25 ml to about 75 ml, or any other volume deemed useful in a smoking article). In some embodiments, such as in resistive heating, to achieve this end, the article preferably can provide about 1 to about 10 Joules of heat per second (J/s), about 2 J/s to about 6 J/s, about 2.5 J/s to about 5 J/s, or about 3 J/s to about 4 J/s.

Figure 10:
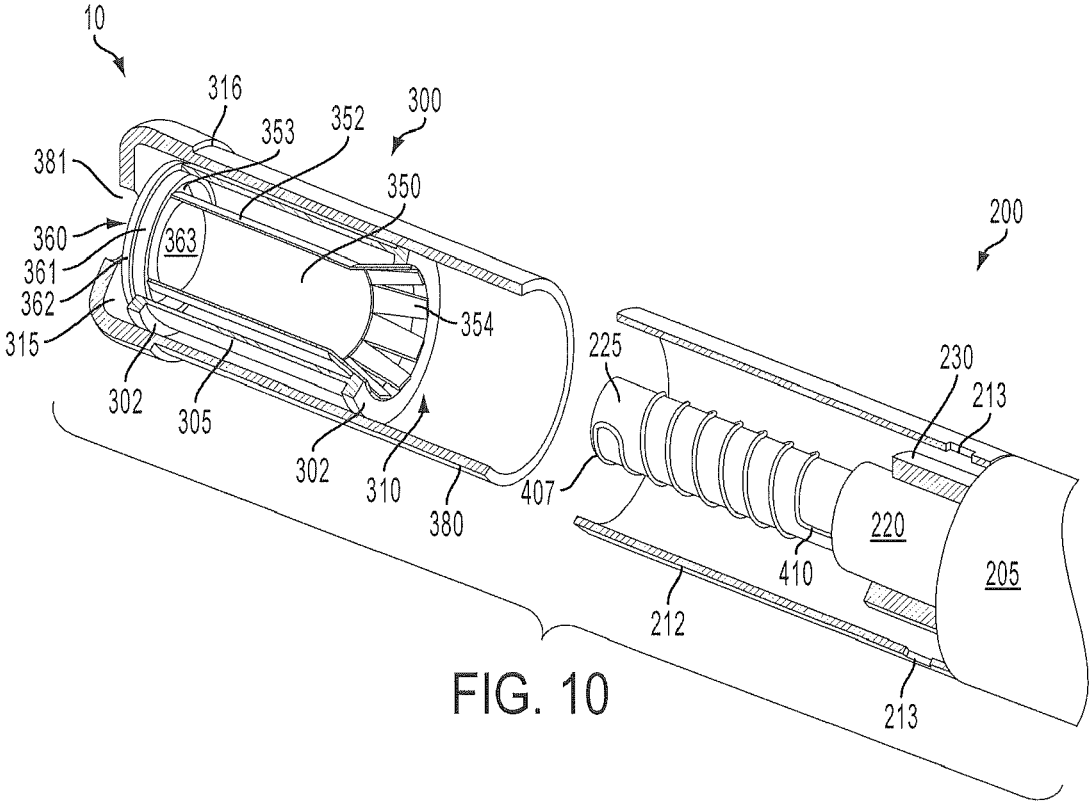
FIG. 10 is a perspective view of a portion of an article according an embodiment of the invention showing a cartridge disengaged from the receiving chamber of a control housing (which is only partially shown), the control housing including a heating member located on a projection to provide for bulk heating of the inhalable substance medium in the cartridge, the cartridge and receiving chamber being partially cut away to reveal the underlying components of the article.

In other embodiments, the article 10 can provide bulk heating of the inhalable substance medium 350. One such embodiment is shown in FIG. 10, wherein the heating member (shown as heating coil 407) is provided as a component of the control housing 200. Similar to the embodiment illustrated in FIG. 4, the heating coil is wrapped around the projection 225, and electrical contacts 410 extend therefrom into the receptacle in the electrical energy source 220. Instead of being present on only a small segment of the projection, however, the heating coil is present along substantially the full length of the projection (which may be described as being present on a large segment of the projection). In some embodiments, the length of the heating coil on the projection can be characterized in relation to the inhalable substance medium. For example, the electrical heating coil 407 (or electrical heating member generally) can be present on the projection along a segment is about 75% to about 125% the length of the inhalable substance medium 350. In other embodiments, the segment can be about 80% to about 120%, about 85% to about 115%, or about 90% to about 110% the length of the inhalable substance medium. In other embodiments, a heating spreading member may be used and may have a length that is substantially identical to the total length of the inhalable substance medium, or a different length as discussed above.

Figure 11:
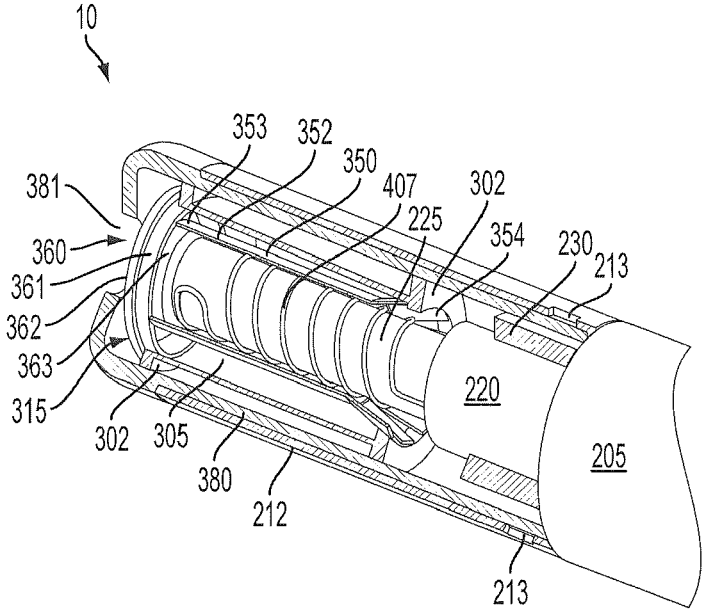
FIG. 11 is a perspective view of the article from FIG. 10, wherein the cartridge is fully inserted into the receiving chamber of the control housing such that the projection with the heating member thereon is fully inserted into the central cavity of the tubular inhalable substance medium and thus positioned to provide for bulk heating of the inhalable substance medium.

FIG. 11 illustrates the embodiment from FIG. 10 wherein the cartridge 300 has been fully inserted into the receiving chamber 210 of the control housing 200. Different from segmented heating, in bulk heating embodiments, complete insertion of the cartridge can correspond to the distance that the cartridge typically can be inserted to begin use of the cartridge. Of course, full insertion is not required, and a consumer can have the option to only partially insert the cartridge so as to reduce the amount of inhalable substance and any aerosol-former released during heating. After one or two heating cycles, the cartridge may be indexed further into the receiving chamber so that the heating coil 407 contacts substantially the full length of the inhalable substance medium 350 (e.g., at least 90%, at least 95%, or at least 98% of the length of the inhalable substance medium). Bulk heating can be useful for embodiments wherein it may be desirable to provide a bolus of the inhalable substance with the initial puff and provide a lower, more constant amount with each subsequent puff.

Figure 12:
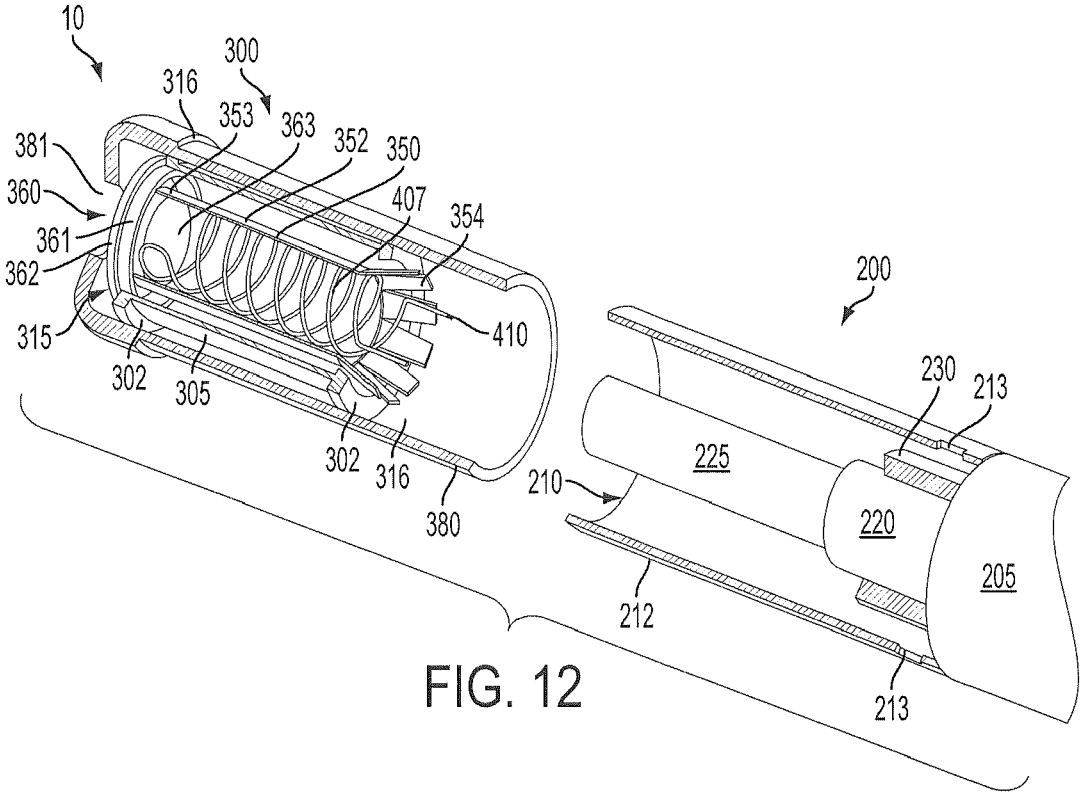
FIG. 12 is a perspective view of a portion of an article according an embodiment of the invention showing a cartridge with a heating member located therein disengaged from the receptacle in the receiving chamber of a control housing (which is only partially shown), the control housing including an electrical energy source with a receptacle for receiving electrical contacts on the heating member to provide for bulk heating of the inhalable substance medium in the cartridge, the cartridge and receiving chamber being partially cut away to reveal the underlying components of the article.

FIG. 12 illustrates a further embodiment of bulk heating wherein the heating coil 407 is provided as a component of the cartridge 300 and thus is disposable. In such embodiments, the electrical contacts 410 for the heating coil can be configured such that when the cartridge is fully inserted into the receiving chamber 210 of the control housing 200, the contacts make an electrical connection with the receptacle of the electrical energy source 220. It can be preferable for the electrical heating member (i.e., the coil 407) to be present within the cartridge along a segment that is about 75% to about 100% the length of the inhalable substance medium 350. In further embodiments, the heating coil can be present the cartridge along a segment that is about 80% to about 100%, about 90% to about 100%, or about 95% to about 100% the length of the inhalable substance medium. Moreover, the heating member may take on a different configuration, and a heat spreading member may be used, as described above, and may have relative lengths noted above. In such embodiments, use of a vapor barrier as the heat spreading member may be particularly beneficial. Likewise, the vapor barrier could function as the heating member in such embodiments to reduce the amount of material in a disposable cartridge.

Although the cartridge 300 and control housing 200 can be provided together as a complete smoking article or pharmaceutical delivery article generally, the components also may be provided separately. For example, the invention also encompasses a disposable unit for use with a reusable smoking article or a reusable pharmaceutical delivery article.

In specific embodiments, such disposable unit (which may be a cartridge 300 as illustrated in the appended figures) can comprise a substantially tubular shaped cartridge body 305 having an engaging end 310 configured to engage the reusable smoking article or pharmaceutical delivery article, an opposing mouth end 315 configured to allow passage of an inhalable substance to a consumer, and a wall with an outer surface and an inner surface that defines an interior cartridge space. The interior cartridge space can include a substantially tubular shaped inhalable substance medium 350 having a wall 352 with an inner surface and an outer surface so as to define an annular space of a specified volume between the outer surface of the inhalable substance medium wall 352 and the inner surface of the wall of the cartridge body 305. In this manner, the inhalable substance medium has a first end 353 in proximity to the mouth end 315 of the cartridge body 305 and a second end 354 in proximity to the engaging end 310 of the cartridge 301. Such disposable unit can be substantially similar in nature to the cartridge 300 illustrated in FIG. 4.

In further embodiments wherein a cartridge 300 is configured to be a disposable unit, the unit can comprise an electrical heating member 400 that heats at least a segment of the inhalable substance medium 350 sufficiently to form a vapor or aerosol comprising the inhalable substance within the annular space. The heating member further may comprise electrical contacts 410 for engaging a receptacle in an electrical power source to allow for current flow through the electrical heating member. Such disposable unit that also comprises a heating member can be substantially similar in nature to the cartridge illustrated in FIG. 9 or FIG. 12. The disposable unit particularly can vary between such embodiments based on the nature of the electrical heating member and associated components in its various embodiments.

In addition to the disposable unit, the invention further may be characterized as providing a separate control unit 200 for use in a reusable smoking article or a reusable pharmaceutical delivery article. In specific embodiments, the control unit may generally be a housing having a receiving end (which may include a receiving chamber 210 with an open end) for receiving an engaging end of a separately provided cartridge. The control unit further may include an electrical energy source 220 that provides power to an electrical heating member, which may be a component of the control unit or may be included in a cartridge to be used with the control unit. The electrical energy source can include a projection 225 that extends therefrom. The projection can have an electrical heating member 400 combined therewith (as in component of FIG. 4 and FIG. 10), and the electrical heating member can have associated electrical contacts 410 that connect the heating member to the electrical energy source. In other embodiments, instead of including a heating member, the projection may comprise electrical contacts that can interact with an electrical heating member provided in a disposable cartridge (as in component 222 in FIG. 9). The control unit also can include further components, including an electrical power source (such as a battery), components for actuating current flow into a heating member, and components for regulating such current flow to maintain a desired temperature for a desired time and/or to cycle current flow or stop current flow when a desired temperature has been reached or the heating member has been heating for a desired length of time. The control unit further may comprise one or more pushbuttons associated with one or both of the components for actuating current flow into the heating member, and the components for regulating such current flow. The control unit even further may comprise indicators, such as lights indicating the heater is heating and/or indicating the number of puffs remaining for a cartridge that is used with the control unit.

Although the various figures described herein illustrate the control housing 200 and the cartridge 300 in a working relationship, it is understood that the control housing and the cartridge may exist as individual devices. Accordingly, any discussion otherwise provided herein in relation to the components in combination also should be understood as applying to the control housing and the cartridge as individual and separate components.

In another aspect, the invention can be directed to kits that provide a variety of components as described herein. For example, a kit may comprise a control housing with one or more cartridges. A kit further may comprise a control housing with one or more charging components. A kit further may comprise a control housing with one or more batteries. A kit further may comprise a control housing with one or more cartridges and one or more charging components and/or one or more batteries. In further embodiments, a kit may comprise a plurality of cartridges. A kit further may comprise a plurality of cartridges and one or more batteries and/or one or more charging components. In the above embodiments, the cartridges or the control housing may be provided with a heating member inclusive thereto. The inventive kits further can include a case (or other packaging, carrying, or storage component) that accommodates one or more of the further kit components. The case could be a reusable hard or soft container. Further, the case could be simply a box or other packaging structure.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An article that yields an inhalable substance, the article comprising:

a substantially tubular shaped cartridge body having an engaging end, an opposing mouth end configured to allow passage of the inhalable substance to a consumer, and a wall with an inner surface that defines an interior cartridge body space;

a substantially tubular shaped inhalable substance medium positioned within the cartridge body and having a wall with an inner surface and an outer surface so as to define an annular space of a specified volume between the outer surface of the inhalable substance medium wall and the inner surface of the cartridge body wall, the inhalable substance medium having a first end in proximity to the mouth end of the cartridge body and having a second end in proximity to the engaging end of the cartridge body;

an electrical heating member that is operatively positioned to provide heat to at least a segment of the inhalable substance medium sufficiently to form a vapor comprising the inhalable substance, the vapor being released from the inhalable substance medium within the annular space; and a control housing having an end for receiving the engaging end of the cartridge body and including an electrical energy source that provides power to the electrical heating member such that when the cartridge body and the control housing are operatively connected, the inhalable substance medium and the electrical heating member align so as to allow for heating of at least a segment of the inhalable substance medium.

2. The article of claim 1, wherein the cartridge body is substantially cylindrically shaped.

3. The article of claim 1, wherein the cartridge body has a cross-section defined by a shape selected from the group consisting of round, oval, and square.

4. The article of claim 1, wherein the engaging end of the cartridge body includes an opening sufficiently sized and shaped to receive at least one component of the electrical energy source.

5. The article of claim 1, wherein the mouth end of the cartridge body is partially occluded.

6. The article of claim 1, wherein the inhalable substance medium comprises tobacco.

7. The article of claim 1, wherein the inhalable substance medium comprises a tobacco-derived material.

8. The article of claim 1, wherein the inhalable substance medium comprises an aerosol-forming material.

9. The article of claim 8, wherein the aerosol-forming material includes a tobacco-derived material.

10. The article of claim 8, wherein the aerosol-forming material comprises a polyhydric alcohol.

11. The article of claim 10, wherein the polyhydric alcohol is glycerin.

12. The article of claim 1, wherein the inhalable substance medium comprises a solid substrate, and wherein the inhalable substance is coated on the substrate, is absorbed or adsorbed in the substrate, or is a natural component of the substrate.

13. The article of claim 12, wherein the inhalable substance is a tobacco component or is a tobacco-derived material.

14. The article of claim 12, wherein the inhalable substance medium further comprises an aerosol-forming material separate from the inhalable substance that is coated thereon or absorbed or adsorbed therein.

15. The article of claim 12, wherein the inhalable substance medium comprises a slurry of tobacco and an aerosol-forming material coated on or absorbed or adsorbed in the solid substrate.

16. The article of claim 12, wherein the solid substrate is a paper material.

17. The article of claim 12, wherein the solid substrate is a tobacco-paper tube.

18. The article of claim 17, wherein the tobacco-paper tube further comprises an aerosol-forming material coated thereon or absorbed or adsorbed therein.

19. The article of claim 1, wherein the inhalable substance medium comprises a vapor barrier on one of the inner surface or the outer surface of the wall.

20. The article of claim 1, wherein the inhalable substance medium is attached to the cartridge body only at the ends of the inhalable substance medium.

21. The article of claim 1, wherein the volume of the annular space between the outer surface of the inhalable substance medium wall and the inner surface of the cartridge body wall is about 5 ml to about 100 ml.

22. The article of claim 1, wherein the cartridge body further comprises an overwrap.

23. The article of claim 1, wherein the cartridge body includes a filter material positioned in proximity to the mouth end of the cartridge body.

24. The article of claim 1, wherein the end of the control housing receiving the cartridge body comprises a chamber with an open end defined by a wall with an inner surface and an outer surface, the wall having a cross-section that is substantially similarly shaped to the cross-section of the cartridge body.

25. The article of claim 24, wherein the chamber wall includes one or more openings therein for allowing entry of ambient air into the chamber.

26. The article of claim 1, wherein the electrical energy source includes a projection.

27. The article of claim 26, wherein the projection has a length of about 10 mm to about 50 mm.

28. The article of claim 26, wherein the electrical heating member is attached to the projection on the electrical energy source.

29. The article of claim 28, where the electrical heating member is a resistance wire.

30. The article of claim 28, wherein the electrical heating member is present on the projection only along a segment of the projection having a defined length.

31. The article of claim 30, wherein the segment is in proximity to an end of the projection.

32. The article of claim 30, further comprising a heat spreading member positioned between the electrical heating member and the inhalable substance medium.

33. The article of claim 30, wherein the cartridge body is configured to index past the projection segment having the electrical heating member present thereon.

34. The article of claim 33, wherein the indexing is manually controlled by a consumer.

35. The article of claim 33, wherein the article comprises a puff actuated switch that automatically indexes the cartridge past the projection segment.

36. The article of claim 35, wherein the distance traveled by the cartridge during indexing is directly related to the duration of the puff.

37. The article of claim 28, wherein the electrical heating member is present on the projection along a segment of the projection that is about 75% to about 125% of the length of the inhalable substance medium.

38. The article of claim 28, wherein the electrical heating member is substantially in direct contact with a surface of the wall of the inhalable substance medium.

39. The article of claim 28, further comprising a heat spreading member that is substantially in direct contact with an inner surface of the wall of the inhalable substance medium.

40. The article of claim 1, wherein the electrical heating member is positioned within the cartridge body.

41. The article of claim 40, wherein the electrical heating member is substantially in direct contact with a surface of the wall of the inhalable substance medium.

42. The article of claim 40, wherein the electrical heating member is substantially in direct contact with a vapor barrier present on a surface of the wall of the inhalable substance medium.

43. The article of claim 40, where the electrical heating member is a resistance wire.

44. The article of claim 40, wherein the electrical heating member includes electrical contacts for interaction with corresponding contacts on a projection included with the electrical energy source such that when heating is activated, heating occurs along the entire length of the electrical heating member.

45. The article of claim 44, wherein the projection of the electrical energy source includes electrical leads.

46. The article of claim 45, wherein the electrical leads form an electrical connection with discrete segments of the electrical heating member such that when heating occurs, only a portion of the inhalable substance medium in proximity to the segment of the electrical heating member in electrical connection with the projection is heated.

47. The article of claim 46, wherein the segment of the electrical heating member that is in electrical connection with the electrical leads of the projection encompasses about 5% to about 50% of the length of the inhalable subject medium.

48. The article of claim 47, wherein the segment encompasses about 5% to about 20% of the length of the inhalable subject medium.

49. The article of claim 45, wherein the cartridge body indexes past the projection segment having the electrical leads present thereon.

50. The article of claim 49, wherein the indexing is manually controlled by a consumer.

51. The article of claim 49, wherein the article comprises a puff actuated controller that automatically indexes the cartridge past the projection segment.

52. The article of claim 1, wherein the electrical heating member comprises a plurality of individual heater elements that individually provide heat to corresponding, individual segments of the inhalable substance medium.

53. The article of claim 1, wherein the electrical heating member is an electrically conductive material with a defined resistance that is integrally formed with the inhalable substance medium.

54. The article of claim 53, wherein the electrical energy source includes a component for conducting electrical energy to the electrically conductive material integral to the inhalable substance medium.

55. The article of claim 1, wherein the electrical energy source includes a battery.

56. The article of claim 1, wherein the electrical energy source includes a capacitor.

57. The article of claim 1, wherein the electrical heating member has a working temperature of about 120° C. to about 300° C.

58. The article of claim 1, wherein the article comprises a component that actuates current flow from the electrical energy source to the electrical heating member.

59. The article of claim 58, wherein the component comprises a puff-actuated switch.

60. The article of claim 58, wherein the component comprises a pushbutton.

61. The article of claim 1, wherein the article comprises a component that regulates a previously initiated current flow from the electrical energy source to the electrical heating member.

62. The article of claim 61, wherein the current regulating component is a time-based component.

63. The article of claim 61, wherein the current regulating component stops current to the electrical heating member once a defined temperature has been achieved.

64. The article of claim 61, wherein the current regulating component cycles the current to the electrical heating member off and on once a defined temperature has been achieved so as to maintain the defined temperature for a defined period of time.

65. The article of claim 1, wherein the cartridge body includes a flow path therethrough such that fluid passage along the length of the cartridge body including the inhalable substance medium is substantially limited to passage through the annular space between the inner surface of the cartridge body wall and the outer surface of the inhalable substance medium wall.

66. The article of claim 1, wherein an end of the inhalable substance medium is attached to the engaging end of the cartridge and includes one or more openings between the annular space and the engaging end of the cartridge, said one or more openings allowing for air flow into the annular space.

67. An article that yields an inhalable substance, the article comprising:

a substantially tubular shaped cartridge body;

a substantially tubular shaped inhalable substance medium with an interior space, the inhalable substance medium being positioned within the cartridge body so as to define an annular space between the inhalable substance medium and the cartridge body;

an electrical heating member that is operatively positioned within the interior space of the inhalable substance medium so as to heat at least a segment of the inhalable substance medium sufficiently to form a vapor comprising the inhalable substance within the annular space; and a control housing having an end for receiving the cartridge body and including an electrical energy source that provides power to the electrical heating member such that when the cartridge body and the control housing are operatively connected, the inhalable substance medium and the electrical heating member align so as to allow for heating of at least a segment of the inhalable substance medium.

68. The article of claim 67, further comprising a vapor barrier associated with the inhalable substance medium so as to be operatively positioned between the inhalable substance medium and the electrical heating member.

69. A disposable unit for use with a reusable smoking article, the disposable unit comprising:

a substantially tubular shaped cartridge body having an engaging end configured to engage the reusable smoking article and an opposing mouth end configured to allow passage of an inhalable substance to a consumer;

a substantially tubular shaped inhalable substance medium positioned within an interior space of the cartridge body so as to define an annular space between the inhalable substance medium and the cartridge body, the inhalable substance medium having a first end in proximity to the mouth end of the cartridge body and having a second end in proximity to the engaging end of the cartridge body.

70. The disposable unit of claim 69, further comprising an electrical heating member that heats at least a segment of the inhalable substance medium sufficiently to form a vapor comprising the inhalable substance within the annular space.

71. The disposable unit of claim 70, wherein the electrical heating member further comprises contacts for making electrical connection with an electrical energy source in the reusable smoking article.

72. The disposable unit of claim 70, wherein the electrical heating member is positioned within the tubular shaped inhalable substance medium.

73. The disposable unit of claim 70, wherein the electrical heating member is in direct contact with the inhalable substance medium.

74. The disposable unit of claim 69, further comprising an overwrap that surrounds the cartridge body.

75. The disposable unit of claim 74, wherein the overwrap extends beyond the engaging end of the cartridge body.

76. The disposable unit of claim 75, wherein the distance the overwrap extends beyond the engaging end of the cartridge body is about 10% to about 90% of the length of the cartridge body.

77. The disposable unit of claim 74, further comprising a filter material positioned in proximity to the mouth end of the cartridge body.

78. A kit comprising:

a case that accommodates one or more further kit components;

one or more disposable units for use with a reusable smoking article, the disposable unit comprising:

a substantially tubular shaped cartridge body having an engaging end configured to engage the reusable smoking article and an opposing mouth end configured to allow passage of an inhalable substance to a consumer; and a substantially tubular shaped inhalable substance medium positioned within an interior space of the cartridge body so as to define an annular space between the inhalable substance medium and the cartridge body, the inhalable substance medium having a first end in proximity to the mouth end of the cartridge body and having a second end in proximity to the engaging end of the cartridge body; and optionally one or more components selected from the group consisting of a reusable control unit, a battery, and a charging component.

79. The kit of claim 78, wherein the reusable control unit comprises a control housing including:

a receiving end for receiving an engaging end of the disposable unit and including an electrical energy source that delivers power to an electrical heating member, the electrical energy source including a projection extending outwardly therefrom and including a component that forms an electrical connection with electrical contacts on the electrical heating member; and a control unit section that houses a power source, a switching component that actuates flow of electrical current from the electrical energy source to the heating member, and a flow regulating component that regulates a previously initiated current flow from the electrical energy source to the electrical heating member.

* * * * *